United States Patent [19]

Eickmann

[11] Patent Number: 4,730,545

[45] Date of Patent: Mar. 15, 1988

[54] AXIAL PISTON MACHINE HAVING A PLURALITY OF MECHANICALLY ACTUATED ROTARY VALVES

[76] Inventor: Karl Eickmann, 2420 Isshiki, Hayama-machi, Kanagawa-ken, Japan

[21] Appl. No.: 913,440

[22] Filed: Sep. 30, 1986

Related U.S. Application Data

[63] Continuation-in-part of Ser. No. 521,874, Aug. 10, 1983, abandoned, which is a continuation-in-part of Ser. No. 64,064, Aug. 6, 1979, abandoned.

[51] Int. Cl.[4] ..... F01B 13/04; F04B 7/00

[52] U.S. Cl. ..... 91/480; 91/499; 417/515; 417/519

[58] Field of Search ..... 91/180, 472, 476, 478, 91/480, 499, 503; 417/52, 269, 515–519; 123/43 A, 43 AA

[56] References Cited

U.S. PATENT DOCUMENTS

| | | | |
|---|---|---|---|
| 584,033 | 6/1897 | Capitaine | 417/519 |
| 1,164,831 | 12/1915 | McDermott | 417/519 X |
| 1,774,662 | 9/1930 | Parks | 417/519 X |
| 2,388,462 | 11/1945 | Beeh | 417/269 |
| 3,326,193 | 6/1967 | Wahlmark | 123/43 A X |

FOREIGN PATENT DOCUMENTS

| | | | |
|---|---|---|---|
| 1426582 | 3/1969 | Fed. Rep. of Germany | 91/499 |
| 2149616 | 4/1973 | Fed. Rep. of Germany | 91/499 |
| 2707163 | 8/1978 | Fed. Rep. of Germany | 417/269 |

*Primary Examiner*—Carlton R. Croyle
*Assistant Examiner*—Paul F. Neils

[57] ABSTRACT

An axial piston device with a plurality of mechanically actuated, rotory valves having their front faces sealing for the control of flows of fluid is suggested for the connection of ports of its housing to ingoing and outgoing passages of a combustion engine or of other pump arrangements, motoring or transmission arrangements. The device includes working chambers which periodically contract and expand their volumes to take in and expel flows of fluid from the working chambers to and through the valves to the ports and for reversed flow direction. The device is thereby specifically suitable for the communication to external combustion chambers which burn coal powder fuel and which are provided with means to remove, in the external combustion chamber or in a passage, unclean particles from the hot gases before they enter into the expander unit of the device. In order to make the device technologically applicable, a number of detailed structures are provided in the device and can include the provision of two revolutionary- or of four- revolutionary cycles to let the chambers be subjected to different fluids at different revolutions of the rotor at a cycle.

14 Claims, 21 Drawing Figures

Fig. 1-A
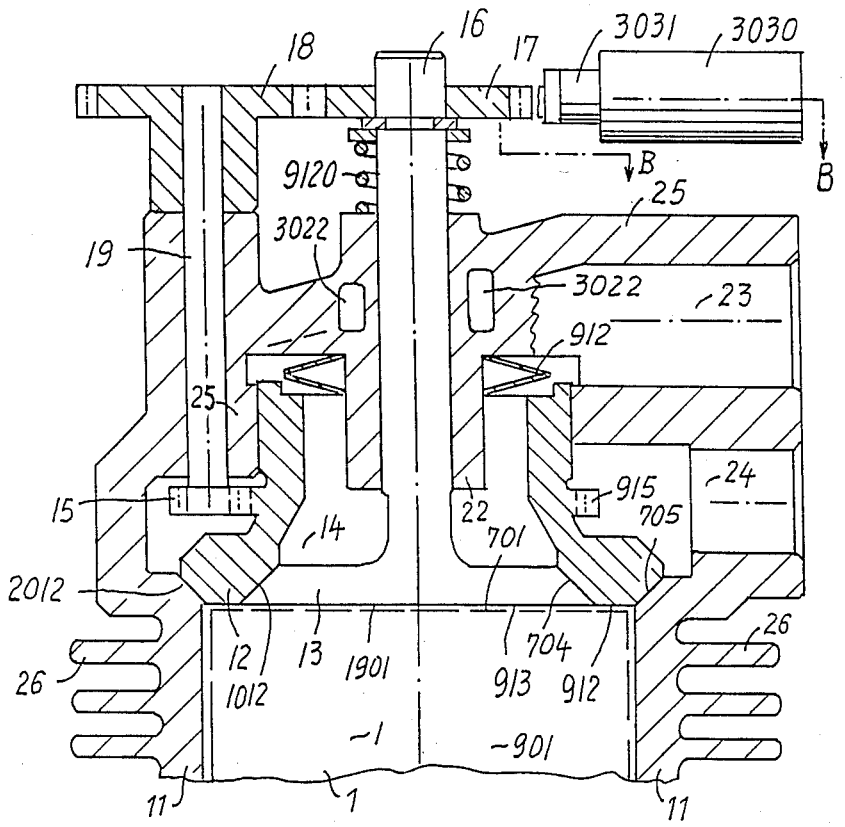
Fig. 1-B
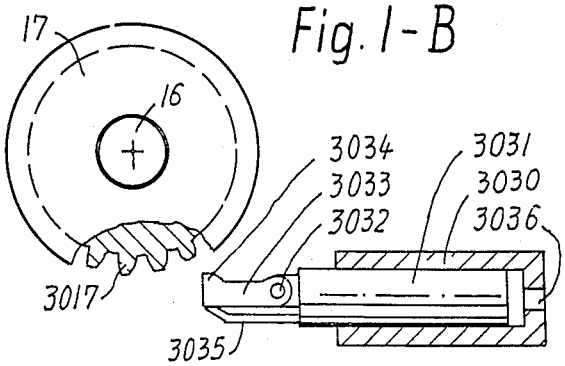

18
16
17
9120
3022
25
19
3022
912
30
32
40
38
39
25
15
14
22
915
705
24
33
42
2012
701
43
64
48
52
46
47
26
12
1012
13
1901
704
913
912
26
44
65
1
901
53
54
11
1
11
45
64
49
50
55
62
56
57
58
59
64
(7)
18
16
17
9120
3022
25
19
3022
23
912
34
60
63
64
(7 in Fig.1)
61
25
15
14
22
915
705
24
36
2012
701
26
12
1012
13
1901
704
913
912
26
1
901
11
1
11

214
214
210
212
213
200
208
201
207
206
211
205
202
204
208
209
204
100
70
91
129
74
72

231
232
226
221
230
222
91-G1
227
225
91-A1
223
229
228
224

239
237
238
129
236
75
73
235
198
197
122
196
234
72
199
74

Fig. 12-A
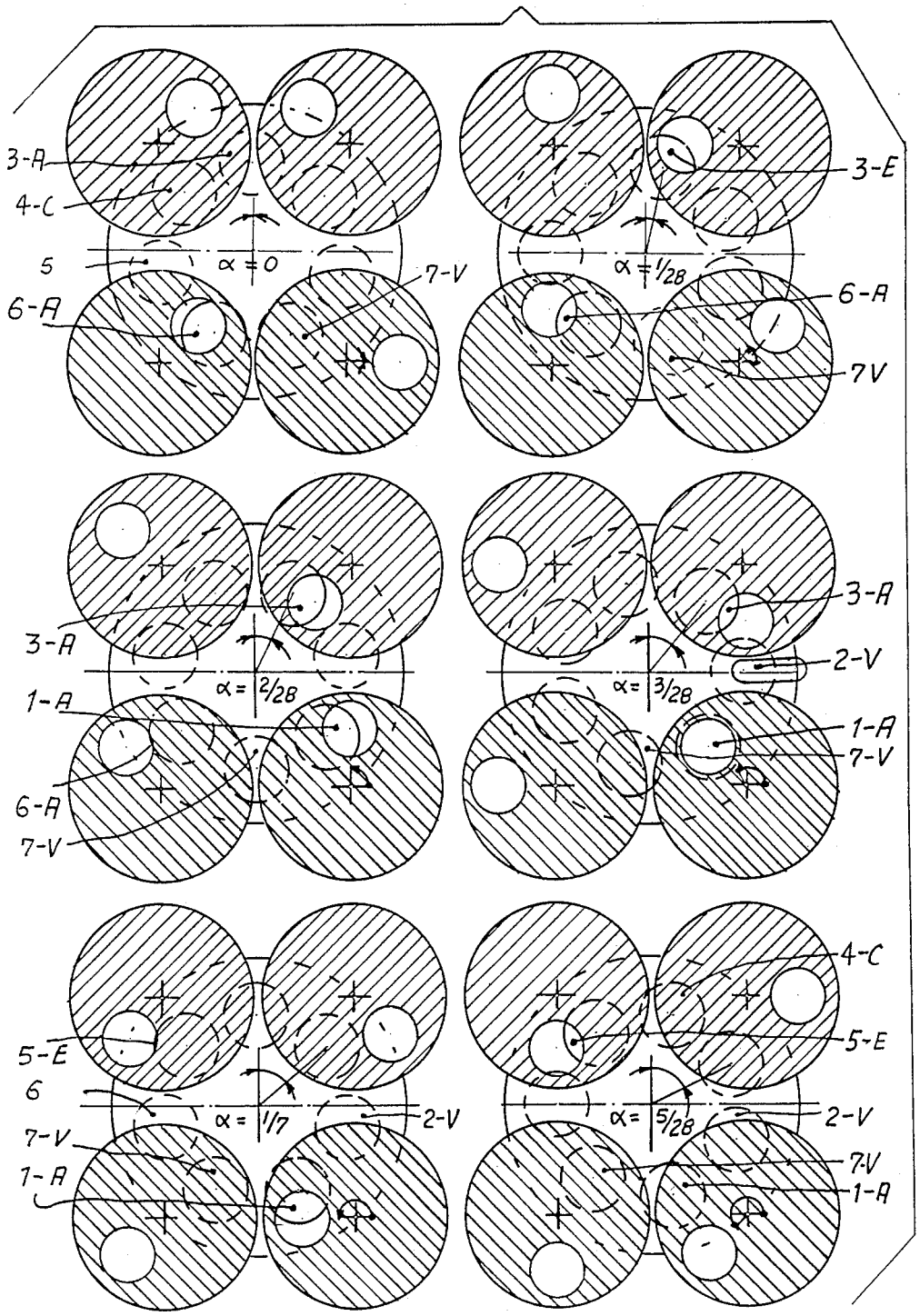

Fig. 12-B
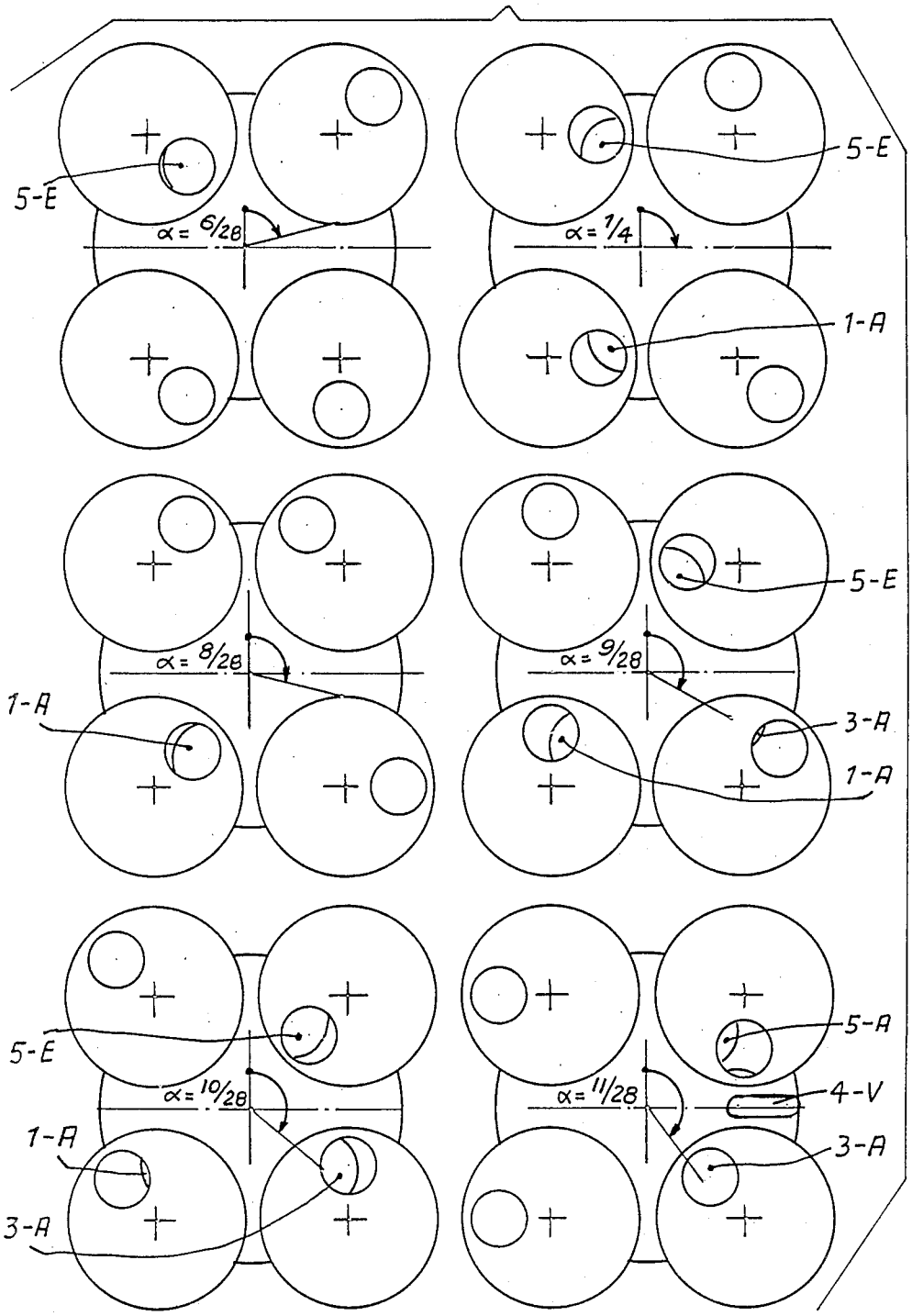

| | | | |
|---|---|---|---|
| Cylinder: 1 = A-E-V-C | | Cylinder: 1 = V-C-A-E | |
| " 2 = V-C-A-E | | " 2 = A-E-V-C | |
| " 3 = A-E-V-C | | " 3 = V-C-A-E | |
| " 4 = V-C-A-E | | " 4 = A-E-V-C | |
| " 5 = A-E-V-C | | " 5 = V-C-A-E | |
| " 6 = V-C-A-E | | " 6 = A-E-V-C | |
| " 7 = A-E-V-C | | " 7 = V-C-A-E | |

IN FIGURES 12-A AND 12-B.

AXIAL PISTON MACHINE HAVING A PLURALITY OF MECHANICALLY ACTUATED ROTARY VALVES

REFERENCE TO RELATES APPLICATIONS

This is a continuation in part application of my at the date of filing of the present application co pending application, Ser. No. 521,874, now abandoned, which was filed on Aug. 10, 1983 as a continuation in part application of my still earlier application Ser. No. 064,064; filed on Aug. 6, 1979, now abandoned, benefit of which is claimed herewith.

BACKGROUND OF THE INVENTION

The common engines still work as piston engines. The newer Wankel engines have dead space and cannot easily lead compressed air out of the compression chamber into a separated combustion chamber.

The gas-turbines operate with a separated combustion chamber in a substantial permanent pressure at constant combustion. However, they also have losses at the delivery of compressed air and the turbines are not easily able to withstand at their high speed meetings with solid particles, when solid fuel would be burned in the combustion chamber.

The common piston engines, wherein pistons reciprocate in the cylinders have inlet valves, outlet valves and piston configurations, which are suitable for a combustion in the cylinder, but which are not suitable to deliver fluid without losses into another chamber.

The known devices and engines are therefore not yet ideally build to maintain a lossless or lossreduced delivery of air or gas into a combustion chamber or air or gas out of a combustion chamber into an expander chamber. They have actually dead spaces in the working chambers which prevent the delivery of all gas out of the chamber or they have bent flow passes which cause losses in flow of fluid.

These drawbacks prevent an efficient engine with separated compressors, expanders and a combustion chamber separated from them, connected to them and between them.

Another difficulty of the engines of the known art, which have been tried to operate one or the other of them with carbon dust or coal powder as fuel, is that the remaining unburned or still solid particles of such fuel disturbed the expansion devices.

The invention intends to overcome these problems and to provide working chambers with reduced or eliminated dead space or to provide a separated combustion chamber with means to clean the gas in it from solid or undesired matter.

THE AIMS AND OBJECTS OF THE INVENTION

The main aim of the invention is to provide separated working chambers which are able to work over the entire operation without dead space or with a reduced dead space in order to be able to deliver a volume of fluid completely out of the working chamber without fluid remaining in dead volume. Or the object is to lead a fluid into such working chamber without subjecting it to enter a dead volume, a volume under "under" pressure or bent flow passes. As far as this aim can not be completely and hundred percent effectively reached, it will be reached almost and with a maximum of practically possible efficiency.

Another aim of the invention is, to provide a combustion engine with at least one separated compressor, at least one separated expander and a separated combustion chamber therebetween wherein all three separated parts operate with a minimum of dead space or with dead space almost zero.

The third aim of the invention is, to provide a combustion chamber capable of buring solid fuel or other fuel, for example coal, carbon dust or coal powder. Such combustion chamber will be provided with means to mix the fuel effectively with the air and to remove undersired remainders of the matter in the combustion chamber. The combustion chamber of the invention will thereby be able to move solid or polluting particles out of the gas flow through the combustion chamber.

The aims of the invention may be obtained by single or plural objects of the invention. For a perfect engine or device of the invention a plurality of objects of the invention may be combined in a suitable manner to obtain the desired aim of the invention.

A specific object of the invention is, to provide valves and arrangements thereto, which secure proper undisturbed flow of fluid through the open valves in substantially unbent flow pathes and which prevent deformation of seats or guides under unsuitable neighboring spaces which contain hot gases and deform under the heat of the hot gases the respective seats. All valve seats are provided under angles relative to the common axis of the coinciding axes of the valves to form tapering inclinations to permit unbent, undisturbed flows of fluid through the open valves.

Also an object of the invention is, to provide a proper cleaning of the valve seats by the provision of gear teeth on the respective valve to make it possible to revolve the valve in the seat for cleaning of the seat and seat face.

More aims and objects of the invention will become apparent from the study of the preferred embodiments, from the study of the Figures and from the study of the claims.

BRIEF DESCRIPTION OF THE DRAWING

FIG. 1 consists of Figure portions 1-A and 1B wherein portion 1-B is a partial sectional view along line 8—8 of FIG. 1-A.

FIGS. 12-A, 12-B and FIG. 13 show a systematic of an arrangement of plural valves for plural actions of the invention.

DESCRIPTION OF THE PREFERRED EMBODIMENTS

Figure 2:
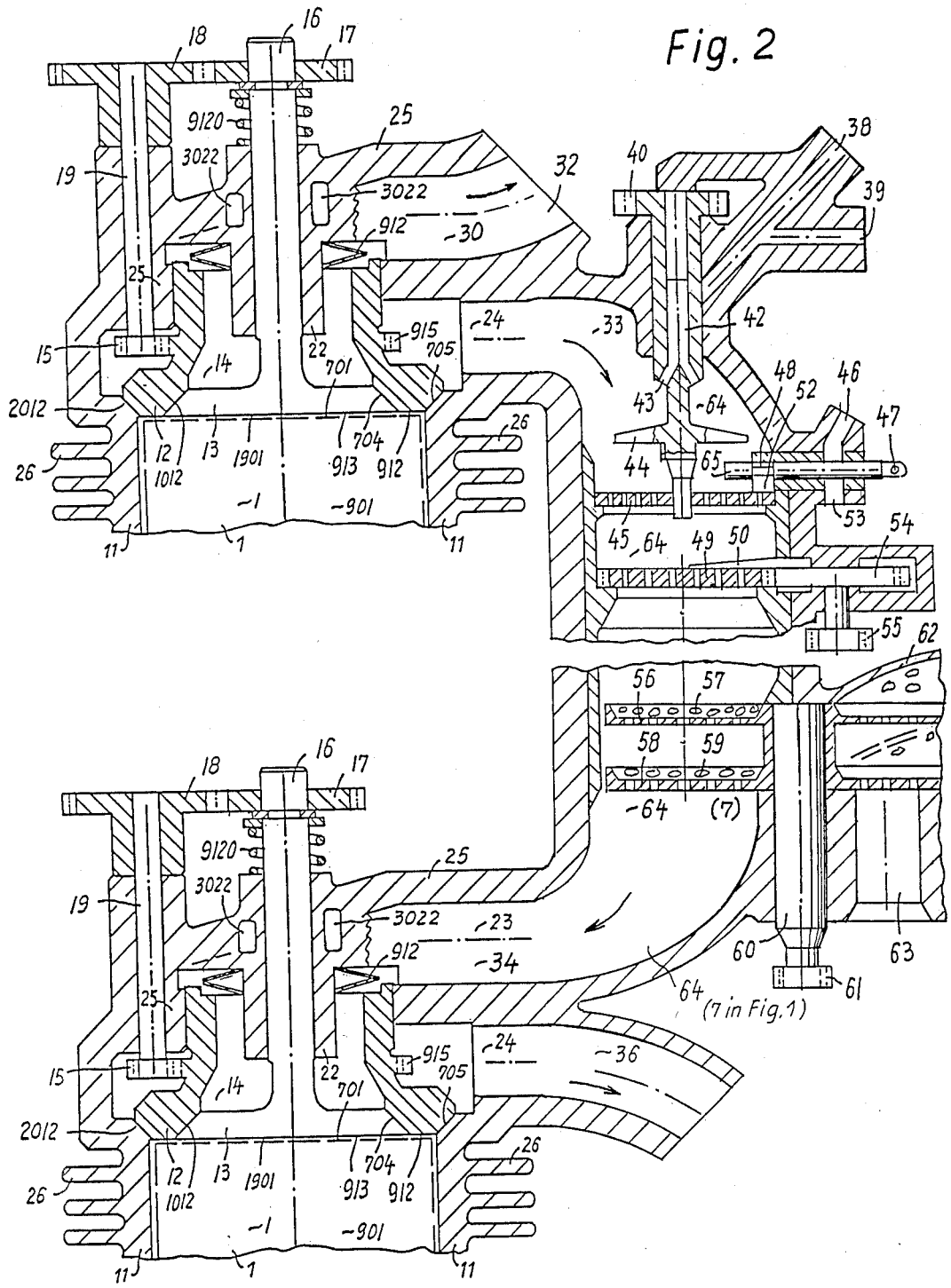
FIG. 2 is a longitudinal sectional view through another embodiment.

In FIG. 1-A the working chamber 1 contains or operates together with a displacement means, for example, a piston, f.e.: 901, which is shown in dotted lines. It may be of a conventional type or one of the other figures. Working chamber or cylinder 1 is contained in a housing 11 which may have cooling devices 26.

On one end of the working chamber 1 with walls 26 is the inlet and outlet portion 25 provided which has the inlet port(s) 23 and the outlet port(s) 24. Outlet valve means 12 may open upwards in the Figure, for example unter the pressure in chamber 1 and close downward again, when the pressure in chamber 1 is smaller. Soft spring(s) 912 may be provided behind the outlet valve 12. Inlet valve 13 may open inwardly under pressure in entrance passage 14, when the pressure in it is higher than in the working chamber 1. Again soft spring means 21 may be provided on the other end of the inlet valve 13. For example an inlet valve shaft 16 and kept by holder(s) 20. Inlet valve shaft 16 may be guided in valve guide member 22 and outlet valve 12 may be guided in a portion of portion 25.

The method to open and close the valves by the difference of pressure in adjacent chambers is by way of example only. Instead, the valves may also be opened by driving members against stronger springs or the valves may be driven rotary plate or disc valves.

The feature of the arrangement of this figure is, that the configurations of the bottom faces of the valves 12,13 correspond to the configuration of the displacement member 901 in order to eliminate dead space between the displacement member 901 and the valve faces, when the displacement member 901 is in the position most close to the inlet and outlet valves. In the Figure piston 901 has a flat top face 1901 and the valves have flat bottom faces 912 and 913. When the piston 901 is in its uppermost position, as shown by the dotted line in the Figure, there remains almost no space between the faces 1901,912 and 913, whereby it is ensured, that all air or gas may be delivered out of the working chamber 1, for example, when the device acts as a compressor. When the valves are co-axial as shwon in the Figure, the largest cross-sectional areas and unbent pathes of inflow and outflow passages can be obtained. Gears 17 and 18 may be provided together with shafts 16, 19 and gears 15,915 to revolve the valves 12 and/or 13. Thereby a self-lapping effect may be obtained or parts between the valve seats and the chamber-seats or head seats may be rotated out from the respective sealing seats of the valves 12 and/or 13. Means should be provided to secure, that the valve(s) revolve only at the respective times. For example, shortly before setting. A temporary and intermittently operating drive means is provided, therefore, by way of example, by drive cylinder 3030 with therein reciprocable piston 3031. A drive head 3034, loaded by spring 3035 an borne in pivot holder 3032 with arm 3033 engages tooth 3017 of gear 17, when pressure is led through entrance 3036 into cylinder 3030. The guide 22 of the valve 13 should be cooled by the cooling spaces 3022 in guide 22. That prevents overheating and sticking of valve 13. The intermittent drive of FIG. 1-B (seen partially also in FIG. 1-A) prevents scratching of the valve seats and of their wear off. The leading of fluid into and out of port 3036 should be timely correctly controlled in dependence on the piston stroke(s).

In FIG. 2 an engine is assembled, consisting of a compressor, an expander and a combustion chamber with accessory devices associated thereto. The top left portion of the Figure shows a compressor with working chamber 41, which may correspond to the compressor of FIG. 1. Air or air-fuel mixture or any other suitable gas enters from entrance port 32 over entrance passage and the respective valve means into the working chamber 41 at the suction stroke of the displacement member or piston therein. The conrods, crankshafts and other conventional parts, which operate the displacement means are not shown in the Figures, because they are known in the art. At the compression stroke of the displacement member in chamber 41 the compressed gas is led through the then opening outlet valve seat over exit passage 31 into the entrance passage 33 of the combustion chamber housing 64. Inside of the combustion chamber housing 64 the combustible matter may be ignited by an ignition means, which for example may be mounted on controller 46 or the combustible matter may be ignited by self-ignition due to high pressure in the respective chamber 41,33,37. The burned or burning matter may then flow through exit passage 37 of combustion chamber housing 64 into the entrance passage 34 of the expander and from there through the respective inlet valve into the expander-chamber 51 of the expander device shown in the left bottom portion of the Figure. After the completion of the expansion, which drives the respective displacement member or piston in chamber 51 downwards, thereby operating over common means the displacement member 901 in chamber 41 of the compressor, the matter is removed at the then beginning exhaust stroke of the displacement member in chamber 51 out of the chamber 51 by opening the respective outlet valve through exit passage 35 into the exhaust muffler or exhaust port 36 and from there out of the engine.

Since the compressor with chamber 41 and the expander with chamber 51 may be built similar to the device of FIG. 1 with only the functions reversed in the expander with chamber 51, the respective parts known from FIG. 1 have no referential numbers in FIG. 2. A common crank-shaft housing may be assembled below the chambers 41 and 51 and the crankshaft therein may be connected with commonly known connecting rods to the pistons in chambers 41 and 51 to operate them in unison. A plurality of expanders and compressors may be mounted together to a common crankshaft and the combustion chamber housing 64 may be common to a number of such compressors and expanders.

The primary purpose of the arrangement of FIG. 2 is, to provide a permanent combustion engine, where the combustible matter is ignited only once and then burns constantly inside of the housing 64 of the combustion chamber. The periodic ignition is thereby spared and a more perfect combustion may be obtained to use the fuel's power more effectively. Poisonous outlet gases may thereby be reduced in poisonous or air polluting content. The combustion may, if so desired or controlled, also already start in the compressor stage and continue into the expander stage. To make this engine effectively working, it is necessary to ensure, that the then compressed matter becomes almost completely delivered from the compressor into the combustion chamber. The prevention of dead space in the compressor is therefore a decisive matter of design. Compressors with big dead space are not effectively useable in this engine. It is further necessary or desired to give the expander a larger volume per stroke, than the compressor, or to apply more expanders than compressors in order that a portion of the power of the expander's work can be utilized to drive the compressor(s). This necessity is valid also for all the other engines of this application. When equally sized compressors and expanders are used, it would be necessary to limit the pressure in the passage from the compressor to the combustion chamber, because otherwise the compressor would not deliver into the combustion chamber 64.

Once the combustible matter is ignited, the process will run permanently until the supply of combustible matter is stopped. The combustible matter may be an air-fuel mixture supplied through the entrance passage 32 and the compressor. Or it may be air compressed in the compressor and a combustible fuel entered from fuel supply device 43 into the combustion chamber 64 to combine and mix therein with the compressed air and thereby to provide the combustion process.

One feature of the engine of FIG. 2 is in addition to the primary purpose, the important purpose to be able to use the engine as an everything burner or all-fuel engine. For example, to utilize the engine of FIG. 2 as a carbon- or coal-engine.

The combustion chamber 64 of FIG. 2 may therefore be provided with means to make the engine able to use gasoline or other fuels than gasoline, for example also to use non-liquid fuels, for example coal or ground coal particles as power supplying fuel.

Such fuel, also small powdered fuel, may be send through fuel supply passage 38 into and through a nozzle 42 and thereout through injecting jet nozzles 43 into the combustion chamber 64.

A second inlet passage 39 may combine with fuel-inlet passage 38. Passage 39 may supply an additional or other fuel or it may supply a driving matter to mix with the fuel of passage 38 or to drive the fuel of passage 38 more forcefully into the nozzle 42. Nozzle 42 may be provided with a driving gear 40 to revolve the nozzle in order to get a good mixing of the fuel injected through jets 43 into the matter coming from compressor 41. Such rotation of nozzles 43 prevents unsuitable mixing and imperfect burning.

The combustion chamber may also have a rotor 44, for example like a fan, to revolve the whole combustible matter in the combustion chamber 64. Such rotor 44 may have a separated drive means or may be be driven by nozzle 42. It may even be fastened on an extension of nozzle-revolving nozzle-42, as shown in the Figure.

By the revolving of the combustible matter in the combustion chamber 64 the heavier portions of the combustible matter, for example non-burnable remainders of powdered matter, are forced radially to the outside portion of the combustion chamber 64.

A filter 45 may be assembled thereafter in the combustion chamber 64 to prevent non-burned powder parts of powder parts from flowing further downward in the combustion chamber 64. Since such non-burning or powder parts would gradually close the holes or pores of the filter 45, the filter 45 may be revolved. That can be done, for example, by extending the rotary nozzle 42 further and to revolve filter 45 by an extension of the nozzle end which already may carry and drive the revolving fan 44. On top of the radial outer portion of filter 45 a shovel 52 may be provided to collect the non-burned power rests or undesired foreign matter and to lead it into the collection space 48 of removel member 47. When the collection space 48 is filled, the member 47 may be moved to the right in the Figure until space 48 aligns with removel passage 53. The remainders of powder will then fall out of collection chamber 48 through passage 53 or the remainders may be blown out through passage 46 into a dust collection tank. Thereafter the remover member 47 may be transferred leftward again into the outgoing leftward position to start a new cycle of dust collecting and removal. Such processes or cycles may be done automatically and periodically by respective accessory drive means of the engine.

If so desired, an additional or a plurality of additional filter(s) 49 may be assembled in the combustion chamber 64 downwards of the first filter 45. Such filters 49 may be stationary or movable. They may for example also be rotary but with another speed of rotation separately driven by gearing means 55. Dust collectors 50 may be added to such additional filter(s) and respective dust remover members may be set.

The poisonous or air-polluting contents of the combustible fuel may partially or totally be removed from the combustible matter or from the burned matter by one or more catalysator members 57 or 59. Such catalysators may, for example, be led onto holders 56 or 58 and such holders may have pores or holes for the flow through of the burned or burning matter. The catalysators may be periodically or permanently blown out or be replaced from the holder(s) 56 or 58 by revolving or moving holders 56 and or 58 by a gearing means 60,61 over a blow-out passage 63. A driving fluid, like for example air, may blow the used up catalysators along a guide member 62 into the air or into a collection tank. Thereafter new catalsysator means may be led or sprayed over the holder(s) 56 or 58.

Thus, the burnable matter will finally, free of any material or work-disturbing matter, enter the expander chamber 51 through passages 37 and 34 over the respective inlet valve. The exhaust will take place over the respective outlet valve and passage 35,36 when the piston in chamber 51 runs in the opposite direction.

It is preferred to provide the combustion chamber 64 with plural inlet passages 33 and plural transfer passages 37 in order to mount the combustion chamber 64 onto a plurality of compressor chamber devices and expander chamber devices. That is also required for the permanent action of the device. When one of the compressors has a suction stroke, another has the compression-oder delivery stroke. And, when one of the expansion chambers 51 has an exhaust stroke, the other acts in an expansion stroke, thereby providing the major portion of the power and energy supplied by the combustible matter in the combustion chamber as useable power or energy from the engine and a smaller portion thereof to drive the suction, compression-and exhaust strokes of the engine.

The combustion chamber 64 with the thereto belonging devices may be build as a complete unit to be able to be mounted onto respective compressor-expander-devices with chambers 41 and 51.

Figure 3:
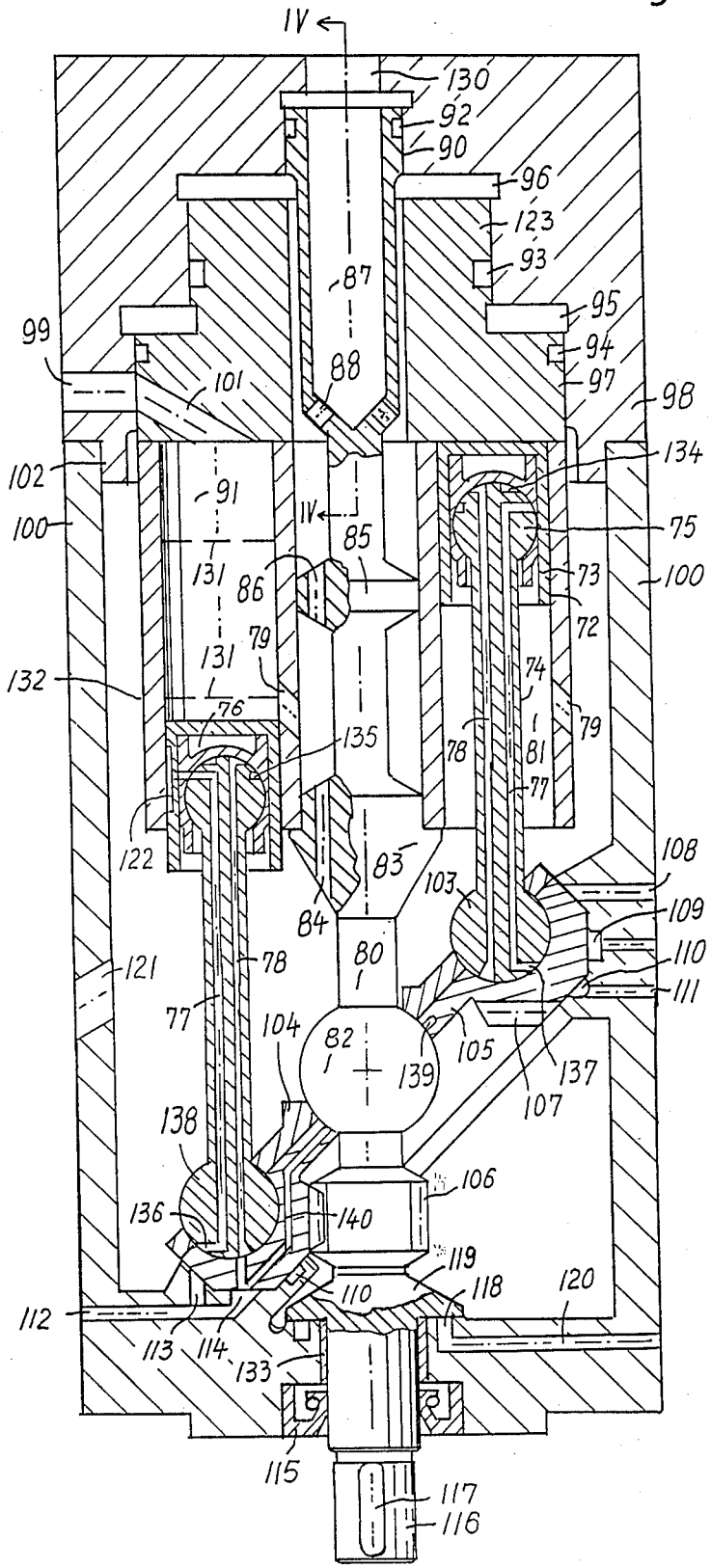
FIG. 3 is a longitudinal sectional view through still another embodiment of the invention.
Figure 4:
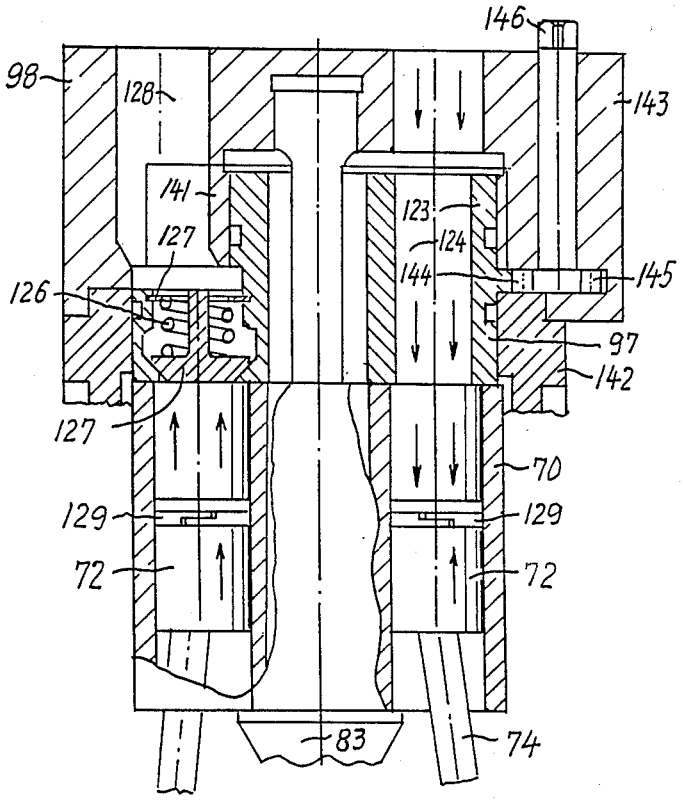
FIG. 4 is a cross-sectional view through a portion of FIG. 3 along the line IV—IV.

In FIGS. 3 and 4 the compressors and expanders of the engine are those of the axial piston stroke type. That is contrary to FIGS. 1 and 2 where reciprocating pistons, driven by or driving a crankshaft over connecting rods or conrods were preferred.

Revolving rotor 70 is driven by shaft 116 or rotor 70 drives shaft 116. Power may be delivered to shaft 116 or taken of therefrom by clutch- or key-means 117. Rotor 70 contains a plurality of cylinder or other working chambers 91 which are generally parallel to the axis of the rotor or inclined thereto. Rotor 70 is therefore occasionally called "a cylinder barrell". Drive plate 105 is inclined under an angle relatively to the axis of the rotor 70. In the drawing the drive plate is inclined under an angle of 45 degrees. That inclination permits piston strokes of up to 3 or more times the diameter of the piston or displacement member 72. When the chambers 91 are round, they are called cylinders. They may, however, as well as the displcacement members or pistons 72 have any other cross-sectional configuration if so desired. Holding plate 105 holds the connecting bar heads 103 in respective, preferred hollow ball part formed seats in the drive plate 105. Drive plate 105 may be driven by gearing means 106, 107 from shaft 116 or vice versa. Drive plate 105 may be borne in bearings 109 to 114.

The chambers 91 in the rotor 70 are preferred to be through-bores or equal cross-sectional area through the entire length of rotor 70 and open towards the outer end thereof. The rotor 70 may, thus, substantially have an outer, radially extending, end face which may be called "head face" or "front face" in sealing engagement with a stationary control face 101 on control body 97 for periodically opening or closing the chambers 91 to passage means in the control body 97.

FIG. 3 shows the engine's head cover 98 to contain two fluid containing thrust chambers 95 and 96 whereof at least one contains fluid under pressure. These chambers are also shown in FIG. 4 but without referential numbers. Control body 97 is inserted into engine head cover 98 and that of the chambers 95 or 96 or both, which contains fluid under pressure presses the control body 98 with its control face or seal face 101 against the end face of the rotor 70 to seal along the rotary face of the rotor 70. FIG. 4 which is cross-sectional view along IV—IV through a portion of FIG. 3, shows, that control body 98 may have a concentric portion close to the cylinder 70 and an eccentric portion 123 behind the concentric portion. Seal means, preferredly heat resistant seal means are provided by 93 and 94 to control body portions 97 and 123 in order to seal the chambers 95 and 96 therebehind. Then eccentric portion 123 prevents rotation of the control body 97.

The control body 98 is provided with an entrance passage 124 and with an exit passage 128. When the device acts as a compressor, the exit passage 128 may contain, close to the piston head 72, a valve 125 with an end face corresponding to the configuration of the piston head face. Valve 125 may be slightly spring loaded by spring 126 and holder 127 in passage 128. Valve 125 may be opened and closed as the respective outlet valve in FIG. 1.

When the device of FIGS. 3 and 4 acts as an expander unit, the suction passage 124 becomes a delivery passage of the burned or burning mixture from combustion chamber 64 and the outlet passage 128 is then an exhaust passage. When the device of the FIGS. 3 and 4 acts as a compressor, the delivery or exit passage 128 will be a delivery passage for the delivery of the compressed matter to the entrace passage 33 of the combustion chamber 64.

A combustion chamber in the spirit of FIG. 2 is mounted to one or more compressor devices of FIGS. 3 and 4 and expander device(s) of FIGS. 3 and 4.

According to FIG. 3, the control body and head 97 and 98 may contain a passage 99 for the supply of a cooling flush-fluid, for example, cool air, to flush and cool the respective cylinder at a portion of the rotation of the rotor. The cooling flush-fluid may leave the respective cylinder or chamber 91 through respective cool-fluid exit ports 79 in the rotor and finally the housing of the engine through cool-fluid exit ports 121.

A permanently flowing cooling fluid flow may enter the engine through cooling fluid entrance 130 and flow therefrom through the hollow shaft end 87, leave it through passages 88 to flow into the medial hub or bore of rotor 70 and through further passages 86 and thereafter through radial cooling passages which are radially extending between adjacent cylinders or chambers 91 through rotor 70. After the permanent cooling flow has passed the inner wall of the rotor, cooled it and passed through the radial rotor passages, thereby cooling the rotor 70 and the chambers 91, it leaves the radial passages through the rotor—dotted lines 131—at the radial outer ends thereof and passing the outer face 132 of rotor 70, the permanent cooling flow also leaves the engine through cool-fluid exits 121.

In addition to the herebefore described working actions of the engine parts of FIGS. 3 and 4, there may be further features incorporated into the respective devices. For example, the shaft 116 may be radially borne in bearings 90 and 133. It may be axially borne in axial bearing 118. Bearing 90 may include a seal 92 for sealing the chamber 96. Rotor 70 may be radially borne on shaft 116 by portions 83 and 85 of shaft 116. The rotor 70 may be axially borne by portion 83 of shaft 116 as far as portion 83 embraces the inner end of rotor 70. Thus, the shaft 116 and rotor 70 are radially and axially borne and thereby able to revolve. The axial position of shaft 116 and rotor 70 are at one end fixed by bearing 118,119 and on the other end by the thrust of chambers 95 or 96 against the control body 97 and thereby by the thrust of face 101 of control body 98 against the outer end face of the rotor 70. The chambers 95 and 96 are accordingly dimensioned and located. The details of chambers 95, 96 and of control body 98 are calculable from my U.S. Pat. Nos. 3,831,496; 3,850,201; 3,889,577 or 3,960,060.

Pistons 72 may have piston seal rings 129 shown in FIG. 4 and they may be hollow or contain insertions 73. The pistons 72 may have spherical ball-part formed beds to contain the ball-part formed inner heads 75 of connecting rods or conrods 74. Conrods 74 may be provided with passages to pass a lubrication, cooling or pressure fluid into respective spaces or recesses in the inner conrod-heads 75.

For example, the rear housing portion may contain lubrication or pressure - fluid entrance passages 108,111,112 or a plurality thereof. Lubrication- and thrust bearing fluid may be passed from them into individual or common fluid pressure thrust or bearing power providing recesses 113,114,108,109,110 and from there through passages 77 or 78 through conrods 74 into conrod inner heads 75 and through them into fluid pressure pockets 134,135 and/or 122. Fluid pressure pockets 134 and 135 bear a part of the pressure excerted from the respective chamber 91 onto the respective piston 70 in order to reduce the mechanical load and/or friction of the respective piston 70 into the respective inner conrod head 75. Fluid pressure pocket 122 may act to bear and counter act partially or totally the centrifugal forces exerted during rotation onto the pistons and or conrods. And fluid pressure pockets 136 and 137, which are communicated to passages 114 or like, may act to bear a part or all of the axial and/or partially radial load of the outer conrod heads 138.

Thrust bearing 118 is supplied with bearing pressure fluid through passage 120. Pressure bearing and lubrication fluid may also be supplied through passage 140 into a fluid pressure pocket 139 around a bearing portion 82, kept between disc 105 and holder 104. Holder 104 may be fastened to inclinded disc 105 by respective holding means, not shown in the Figure, because they may be simple bolts or retaining means. The outer conrod heads 103 or 138 are then held in their seats in inclined disc ring 105 by holding ring 104.

It may be noted, that in the engine, the pressure in the working chambers 91 is not equal as in hydraulic devices, but changes gradually during the respective half of rotation of rotor 70, at which the pistons 70 run from the outermost position, also called "outer dead point38 left side of the Figure to the innermost position, also called "inner dead point"—right side of the Figure—or vice versa and thereby gradually increase or decrease the volumes of the chambers 91. Consequently, the force exerted by the pressure in the respective chamber 91 onto the respective piston 70 and the respective conrod 74 gradially changes with each half of a revolution of rotor 70. It is therefore preferred to set a plurality of entrance passages 112,111,108 angularly around the periphery of housing 100 and to supply them with different fluid pressures. With lower pressure in those zones, where lower pressure is present in the respectic chamber 91, with medial pressure in those zones, where medial pressure acts in the respective chamber 91 and with higher pressure in those zones, where higher pressure acts in the respective chamber 91. As more such separated entrance passages are set, as more detailed will be the counter acting fluid pressure recesses in the conrods and pistons be supplied in order to have such forces as close as possible to bear the forces exerted out of the respective chamber 91 onto the respective piston. In the ideal case the said recesses will bear 80 to 98 percent of the forces exerted from the fluid pressure in the respective chamber 91 onto the respective piston 72. The fluid pressure pockets 122 may be supplied contrary to the FIGS. 3 and 4 by a permanent pressure in order to permanently act contrary to the acting centrifugal forces of pistons and conrods. The Pistons 72 and conrods 74 may for that purpose have devices to prevent their rotation relatively to recesses 122 in order to maintain the recesses 122 in direction contrary on the piston to the said centrifugal forces. The conrods 74 may also have return fluid passages 77 or 78 to return the heated fluid out of the respective fluid pressure recesses 122,135,134,136,137 and the like.

A very specific feature, which is not in all of the engines applied, but which can be applied, is shown also in FIG. 4.

The head 98 is divided into two portions 142 and 143 in order to enable the assembly of an inner portion 141 and of a gear means 144,145,146.

The control body 97 contains a gear part portion 144 which is engaged by an adjustment gear 145. Adjustment gear 145 can be controlled by handle 146 during operation of the device. The handle 146 thereby pivots the eccentric portion 123 and the inner portion 141 in a limited extend in clockwise or counterclockwise direction. Thereby the passages or valves 124 or 125 are moved in clockwise or counterclockwise relatively to the inner and outer death points or extremity locations of the pistons 72 in rotor 70. The consequence thereof is, that the fluid leaves or enters the respective chambers 91 either before or after the inner death points of the pistons 72.

By this matter if becomes possible to run the engine in different cycles. For example in one extreme case in a low temperature turbine engine like cycle and in the other extreme in a hot high pressure cycle with after compression in the expander stage of the engine. The latter cycle uses a shorter combustion chamber, so, that only a part of the combustion completes in the combustion chamber. The burning gas enters then into the expander unit before the inner death point of the expander and compresses in the chambers 91 of the expander in a second compression. An extremely high pressure during further combustion in the expander stage then appears and provides an extremly good second burning stage and an extremely good fuel efficiency of the engine. The combustion at such high pressure leaves no remainder of powder, even when coal dust or carbon dust is used as driving and burning fuel in the engine.

The adjustment by handle 146 is steplessly variable and makes gradual change from one of the cycle over other cycles to the finally desired cycle possible and thus, makes it possible to run the engine in a cold cycle at idling and in a hot high power cycle at desired times, like for example take off of aircraft, helicopters or at passing other vehicles on the road.

Figure 5:
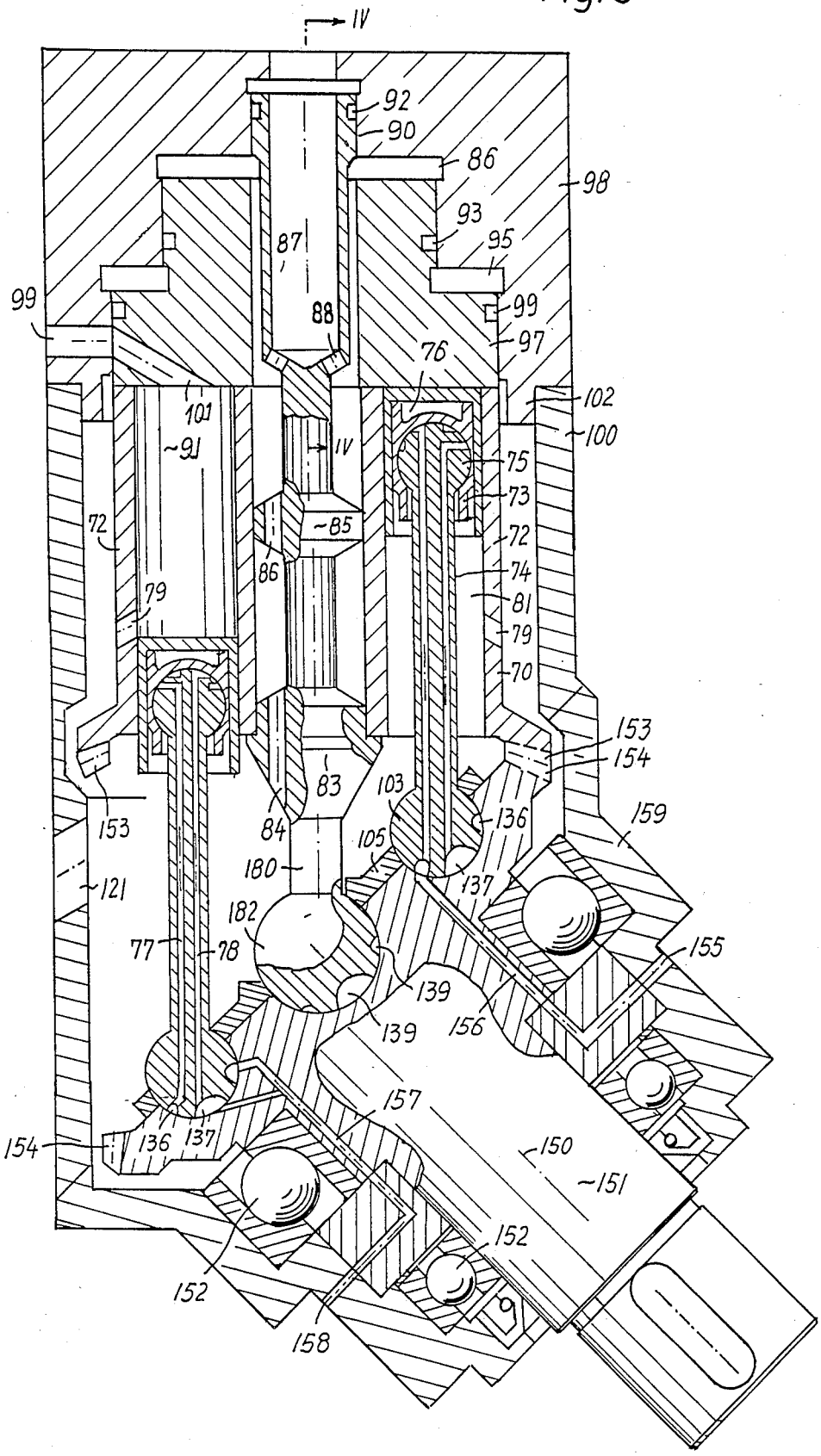
FIG. 5 is a longitudinal view through another embodiment of the invention.

In the other embodiment of an engine of the invention, as shown in FIG. 5, the control body and the rotor as well as the means associated to them are similar to those shown and explained in FIGS. 1,2 or 3 or 4.

However, the inclined plate 105 of FIG. 3 and the shaft of FIG. 3 are replaced by a medial shaft 180 and by an inclined drive- or driven axis 150 of a driving or driven shaft 151. Inclined axis shaft 151 may be inclined 20 to 45 degrees relatively to the axis of the rotor 70 and the shaft 154 contains the seats for the outer conrod heads 103 and the seat for the inner head 182 of medial shaft 180. Medial shaft 180 guides and holds the rotor 70 by end bearing 90 and bearing of its outer head 182 in the respective medial seat in shaft 151. Shaft 151 and rotor 70 are revolved in unison for example by the application of gears 154 and 154 on shaft 151 and rotor 70. Holding plate 104 is similar to that of FIG. 3 and fastened to the respective end of shaft 151 which contains the seats for the medial shaft 180 and the conrod heads 103.

The fluid pressure passages 108.111 and-or 112 of FIG. 3 are replaced in FIG. 5 by passages 155,156,157 and 158. They extend from a portion 159 of the housing through a portion of the shaft 151 and end in the respective seats to supply fluid into the respective recesses 136 and 137 in the outer conrod heads 103 or the seats thereof. They may also lubricate and pressure-supply the recess 139 of the medial shaft head 182 or its seat.

Figure 6:
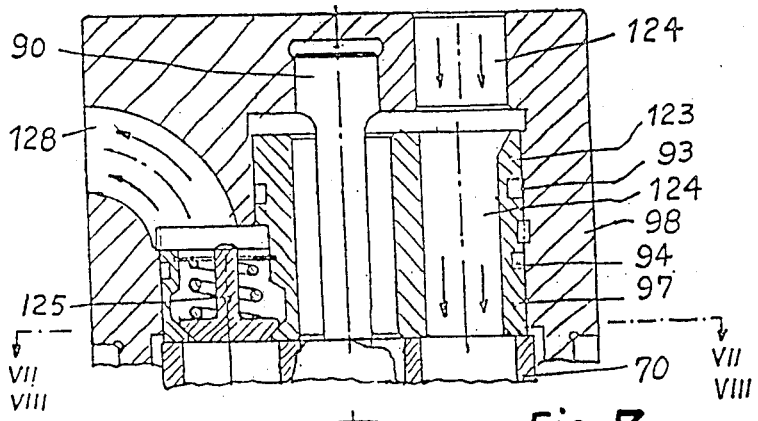
FIG. 6 is a portion of an alternative sectional view of an embodiment of the invention.

FIG. 6 repeats basically the upper housing 98 of the FIGS. 3 or 4 with the exception, that it shows, that the passages, for example 128, may also extend radially instead of axially from the engine head 98.

Figure 7:
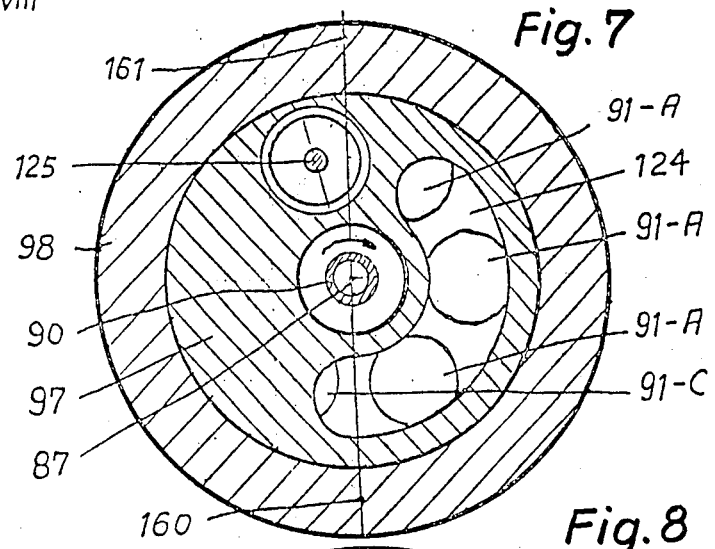
FIG. 7 is a cross-sectional view through FIG. 6 along line VII—VII.
Figure 8:
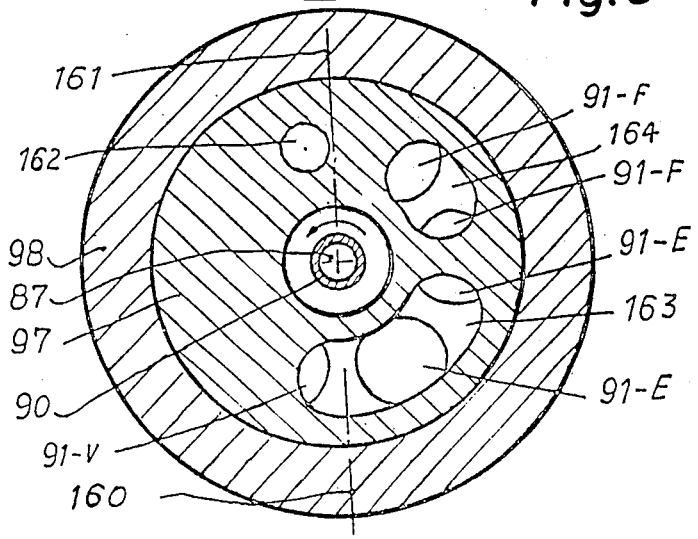
FIG. 8 is a cross-sectional view through FIG. 6 along line VIII—VIII.

FIGS. 7 and 8 are sections through FIG. 6, along VII or VIII, whereby FIG. 7 shows the head 98 acting on a compressor and FIG. 8 shows a head acting on an expander unit. 97 show the control body of FIGS. 3 or 4 respectively in slightly, if any, varied manner and the shaft and its passage are shown by referentials 90 and 87. The arrows in FIGS. 7 and 8 show the direction of rotation of the rotor 70. 161 in said Figures shows the inner dead point locations of the pistons and 160 the outer dead point locations of the pistons respective to the sections of FIGS. 7 and 8 respectively.

The purpose of FIGS. 7 and 8 is, to show a preferred and suitable location of the most simple embodiment of the passages therein.

Thus, FIG. 7 demonstrates, that the exit valve 125 is located very shortly before the inner dead point of the pistons. On the right side in the Figure the suction port 124 is shown as extending almost over the entire region, where the pistons move outwardly in chambers 91. The respectively visible suction chambers are shown by 90-A referentials. The suction port 124 may extend even a little over the outer dead point 160 of the pistons, if so desired. At the compression stroke at the left side of the Figure the here non-passaged control body 97 closes the respective chambers 91.

In FIG. 8 an expander unit's control body 97 is shown with an entrance port 162 which in the inner dead point 161 or shortly therebefore or shortly thereafter delivers the burned or burning gas into the respective chambers or cylinders 91. At the thereafter following expansion stroke the chambers or cylinders 91 are closed by the here uninterrupted and un-passaged control body 97. At the outer dead point 160 or shortly therebefore or shortly therafter begins the exit port 163 which carries the used exhaust gases out of the exhausting chambers or cylinders 91-E. Thereafter and before the inner dead point 161 of the pistons a cooling and chamber flash-flooding entrance port 164 is located and sends a flash-flood flow through the chambers or cylinders 91-F. This flushing or flowing through of the hot cylinders 91-F provides a good cooling and also blows any undesired particles out of the cylinders 91-F in accordance with the invention and in order to through any material disturbing matter out of the chambers 91-F. This is an important matter of the invention in this Figure.

Figure 9:
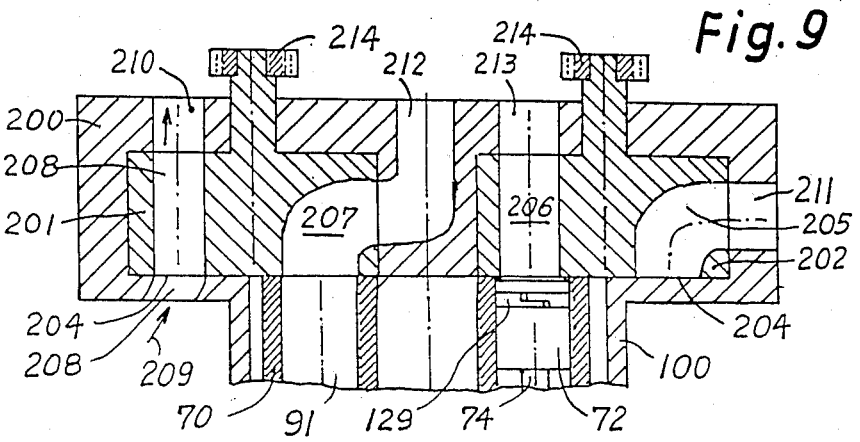
FIG. 9 is a longitudinal sectional view through an embodiment of a valve head of the invention.

FIG. 9 illustrates, that one or more rotary or moveable valves with flat radially plane tip faces 204 may become assembled with their flat faces 204 against the radially plane head face of the rotor - or chambers containing body - 70 of FIGS. 3 or 5. The right side of the Figure shows a piston 72 in the position of the inner dead point and the left side cylinder would have the piston in the outer dead point, so, that the piston is not visible in the portion of body 70 shown in the Figure. Such valves seal with their respective seal face 204 along the head face of the chambers containing body 70. They may be provided in a housing portion 200 and may be moved or revolved by gearing means 214 in dependence on the rotation of rotor 70 either individually or in unison. It is preferred to revolve the valves 201 and/or 202 and/or others in a direction contrary to the rotary direction of rotor 70. Valves 201 etc. may have respective passages 205 to 208, respectively, and they may end either axially into ports 210,213 or they may end radially of the respective valve in ports 212 or 211. The passages 205 to 209 communicate periodically to axial ports 212,213 and radial ports 211 of the housing portion 200 with one set of the ports communicatable to an ingoing passage of a combustion chamber of a combustion engine and another set of the ports communicatable to an outgoing passage of the mentioned combustion chamber, whereby the passages 205 to 209 may serve for the transfer of the air into suctioning chambers 91, for the transfer of compressed air or gas from the chamber 91 into the combustion chamber 64 and/or for the transfer of burned or burning gas from the combustion chamber into the expansion chamber 91. But one or more of them may also serve for the transfer of a cooling flush air from port 208 by arrow 209 through the valve 201 or like for cooling the same. The passages or one or more of them may also be used for sending a cooling flush air through the respective chamber(s) 91.

The axes of the cylinders 91 are distanced from the axis of the rotor 70 by a first radial distance, while the axes of the valves 201,202 etc. are distanced from the axis of the rotor by a second radial distance with the second radial distance being larger than the first radial distance. This is suitable to permit the application of respective gearing means between the rotor and the valves. The gears 14 of the valves may be driven by a series of gears which may be set radially of the rotor 70, through or around the housing 100. Such arrangement permits specific speed ratios of the valves respective to the rotary speed(s) of the rotor 70, for example, to obtain the specific effects of FIG. 9, which are described and illustrated by FIGS. 12 and 13.

Figure 18:
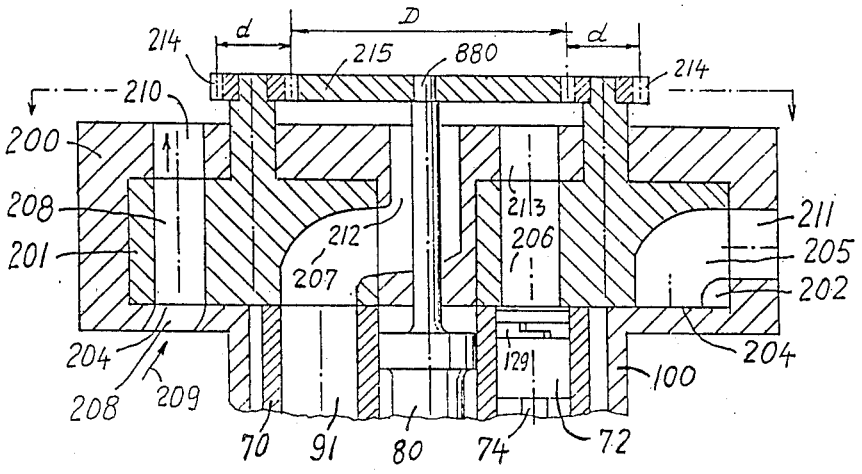
FIG. 18 is a longitudinal sectional view through a head of an engine of the invention.
Figure 19:
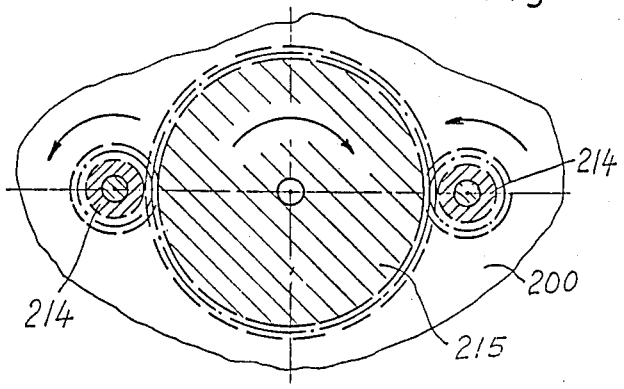
FIG. 19 is a cross sectional view through FIG. 18 along the arrowed line thereof.

How the valves 14 may be driven in dependency on the revolutions of the rotor 70 is shown by way of example in FIGS. 18 and 19. FIG. 18 corresponds substantially to FIG. 9, however, the drive means to revolve the mentioned gears 14 are added in FIG. 18. Thus, the rotor 70 is provided with a medial shaft 80 as in FIGS. 3 and 5. (In FIG. 5 this shaft has referential number 180.) The medial shaft 80 is provided with an axial extension 880 which extends through the head housing 200 and which carries on its end the primary gear 215. The primary gear 215, driven by shaft 80–880 with the same rotary speed as the rotor 70, meshes with the earlier mentioned gears 14. Consequently the gears 14 are driven in opposite rotary direction than gear 215 and rotor 70 revolve. FIG. 19 which is the cross sectional view through FIG. 18 along the arrowed line of FIG. 18 shows by the arrows in FIG. 19 the rotary directions of the gears 215 and 14 for the case that the primary gear 215 revolves clockwise in FIG. 19. If gear 215 revolves clockwise then the gears 14 revolve counterclockwise. If the gear 215 revolves counterclockwise then the gears 14 revolve clockwise. The relation of the diameters or of the number of teeth of gears 14 and 215 define the transmission ratio between the mentioned gears. If the rotor has 7 cylinders, the gears 14 shall revolve 3.5 times faster than the rotor revolves, as earlier mentioned. In the case the meshing diameter "D" of the primary gear 215 must be 3.5 times bigger than the meshing diameter "d" of the gears 14 of the valves. This relationship is shown in FIGS. 18 and 19. For memory, if the number of the cylinders in the rotor is "N", then the gears 14 must revolve "N/2" times faster than the primary gear 215. If, for example, the number of cylinders is N=9, the gears 14 must revolve 4.5 times faster than gear 215; if "N" is 5, the gears 14 must revolve 2.5 times faster than gear 215 and the meshing diameters of the gears must have the respective diameters of this ratio relative to each other. While the drive means 880 is in FIGS. 18 and 19 led through the engine, the drive means may also be set outside of the housing for connection of the shaft of the engine with the gears 14.

Figure 10:
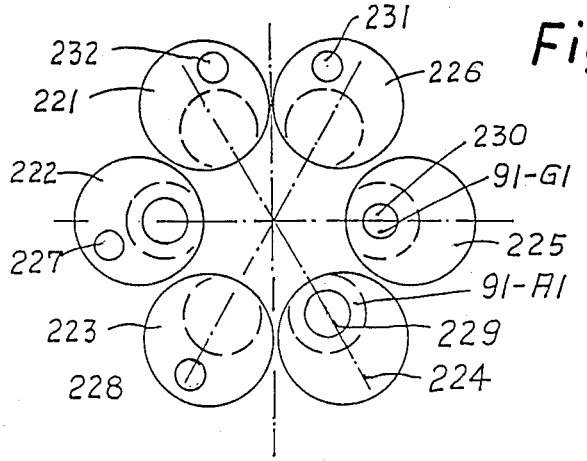
FIG. 10 is a schematic show of plural valves in a valve head of the invention.

FIG. 10 demonstrates, that a plurality of such valves may be assembled relative to the respective chambers 91. For example in the situation shown in the Figure, passage 229 of valve 224 may send the suction gas or air into the chamber 91, A1. Valve 223 may move the port 228 away to close the respective chamber 91. Valve 222 may also close the chamber 91 or send a flush-cooling air through its port 227 into a respective chamber 91. Valves 221 and 226 are shown to hold the cylinders closed, but also containing ports 232 and 231 for opening the respective cylinder chambers 91. Valve 225 is shown just to send a burned or burning gas through its port 230 into chamber 91-G1. The respective valves will at other times of rotation of rotor 70 serve for opening of the respective chambers for the other purposes, like transfer of the respective gases into or out of the respective chambers 91. The opening and closing by the valves is respectively accomplished by their movement or rotation via drive means 214 of FIG. 9.

Figure 11:
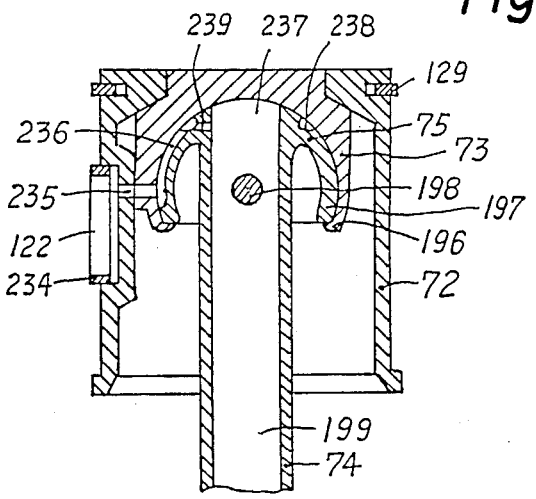
FIG. 11 is a longitudinal sectional view through a piston of the invention.

In FIG. 11 a respective sample of a piston and conrod is shown in a larger scale for making the portions better visible. Piston 72 contains grooves for the usual reception of sealing piston ring(s) 129. Medial portion 73 may be integral with piston 72 or an insert therein. It contains the reception bed for the reception of the inner conrod head 75. In axial piston devices the reception bed must be a part of a hollow ball's inner face and the conrod head 75 must have a form of a portion of a ball. The conrod head 75 fits closely in the reception bed in portion 73 and is able to swing therein. The piston 72 is hollow to be of little weight. The conrod 74 contains passages or is hollow to be of little weight too and the bore 199 then serves as a fluid pressure supply passage. It supplies pressure fluid into the open bore or recess 237 to bear the main force of the pressure in the chamber 91 against the head face of the piston 72. Additional fluid pressure pocket 238 which may be an annular recess, adds to the bearing of the load by recess 237. The conrod head 75 is embraced by a holding portion 196 of the medial part 73. In practice the head 75 is inserted into the reception bed and the portion or holding portion 196 is then deformed by a hammer blow or a press to embrace the inner portion 197 of the conrod 74.

At very high revolutions of the engine, the weight of pistons 72 and of the conrods 74 trends to press the pistons outward against the walls of chambers 91 by centrifugal force. To prevent too high a friction between the piston and the cylinder wall of chamber 91 a fluid pressure balancing pocket 122 may be provided in the radially outer part of the piston 72 adjacent the outer portion, radial outer portion, of the wall of the respective chamber 91. A seal insert 234 may be inserted into the balancing pocket 122 to seal it from escape of pressure fluid. Pressure fluid may be led from passage 199 in conrod 74 through passage 239 into annular pocket 238 and from there through passages 236 and 235 into balancing pocket 122. Arresting means or pin 198 prevents rotation of the piston relative to the wall of chamber 91 when applied and when a respective arresting device is also applied to the conrod 74. The cross-sectional area of the pocket 122 is calculated and applied in combination with the pressure in fluid in said passages to be substantially equal or equal to a part of the centrifugal forces of piston and conrod portions at the usual, highest or average speed of the rotor 70. In case of equalness of the pressure force in pocket 122 to the said centrifugal forces, any wear between piston 72 and chamber wall 91 is prevented.

Figure 13:
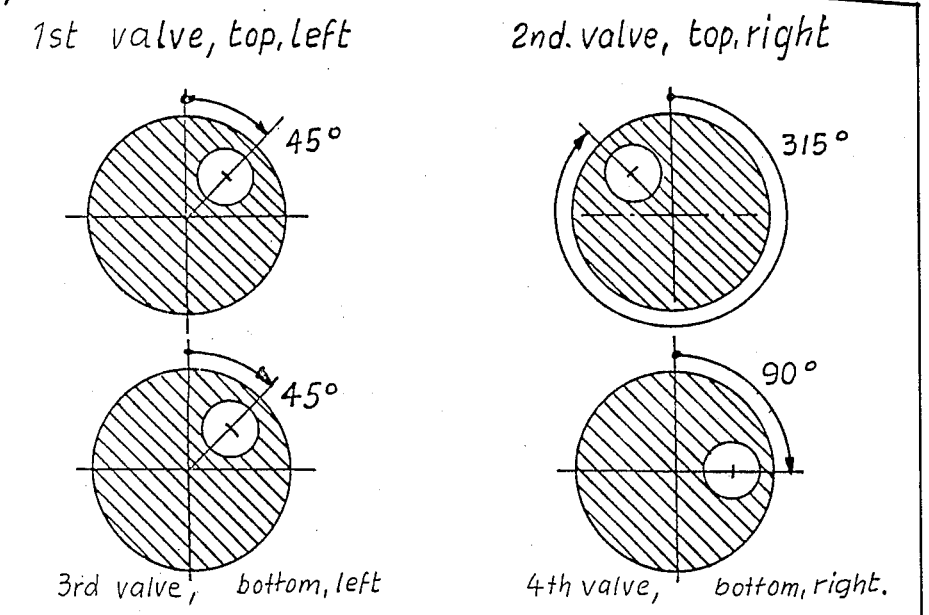

FIGS. 12A,12B and 13 show multiple rotary valves on a multiple cylinder rotor engine. By these Figures a number of features of practice are shown.

For example, the rotor 70 may have an uneven number of cylinders 91, for example 7 in the Figures. The valve head may contain four or six valves; in the Figures there are 4. The valves revolve in a rotary direction opposed to the rotary direction of rotor 70. The valves revolve with a rotary angular speed one half times higher to the number of changes 91 in rotor 70 relative to the rotor 70. In the case of the Figures with seven chambers 91 in rotor 70 the valves revolve 3.5 times faster then the rotor 70. The Figures show the positions of the rotors and valves at 1/28 th intervals after start of the revolution at angular interval zero. The locations of the passages in the four valves relatively to their angle beta=zero positions is shown in FIG. 13. The beta, gamma, delta, lambda zero positions of the valves corresponds to alpha zero position of the rotor.

Such rotor 70 may now be used as a single rotor for all four actions of the engine, namely suction, compression, expansion and exhaust. Flushing cooling actions may be added by additional valves or moving members and so may the the entrance and exit of the gases. In the Figures the bottom valves serve for opening at suction or intake and for closing at expansion. The top valves serve for opening at exhaust and for closing at compression. The chambers 91 have numbers 1 to 7 in the Figures. The indicia (indexes) mean:

A=Intake;
C=Compression;
V=expansion or combustion; and
E=exhaust.

The engine of this type has not only the feature, that a single rotor is enough to contain the working chambers, but the additional important feature, that local overheating of the parts of rotor 70 is replaced by an average heat of it. That is obtained thereby, that each cylinder never serves equal functions in succession, but is used at rotations for different succesions of functions. For example one cylinder chamber 91 in the succession: V - C - A - E and the following in the succession: A - E - V - C.

After one revolution of the rotor the sequence for the respective chamber 91 reverses to: A - E - V - C; and that of the thereafter following chamber 91 to the sequence: V - C - A - E. Thus, every cylinder is at two revolutions subjected to different actons of cycles. The rotor 70 obtains thereby an average temperature in all parts of it, so, that a welding or sticking under local over-heating is effectively prevented.

When more valves are applied flushing actions close to one or more locations of the movement may be added to the above described sequences.

At positions 2-V and 4-V in rotary alpha positions 3/28 and 11/28 of FIGS. 12A and 12B the flow of hot gas into the respective chambers 91 is shown by opening the reciprocating valves in these positions.

The bottom valves open and close two or three adjacent cylinders by a common work in unison and so do the upper valves. The portions of cylinders 91 in alignment are written in bigger lines and the numbers and actions of the respective passages and cylinders in these positions are indicated by the indices therein.

Figure 14:
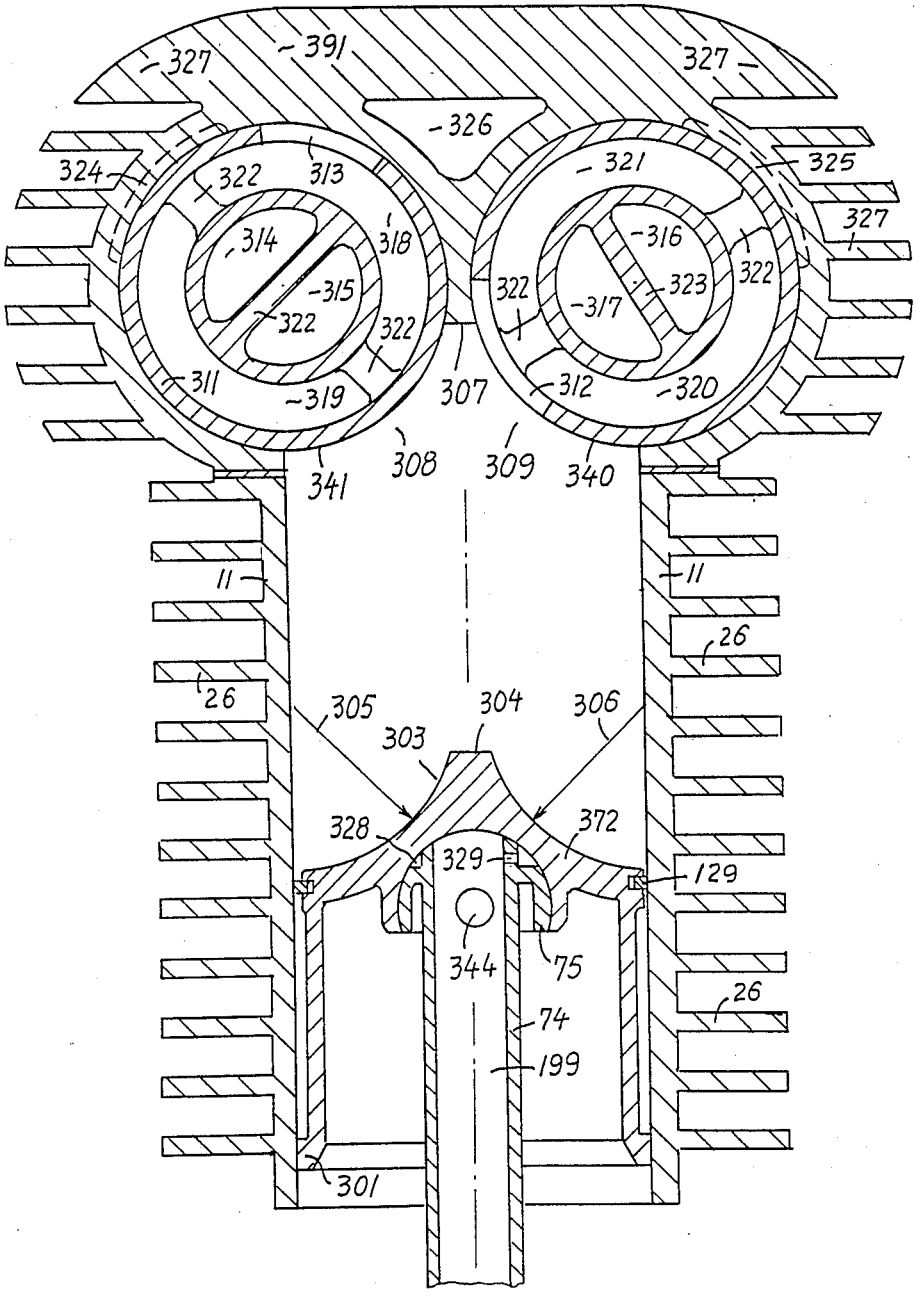
FIG. 14 is a longitudinal sectional view through another embodiment.

In the embodiment of FIG. 14 the axially opening and closing valves of FIGS. 1 to 3 and the rotary valves with axes parallel to the axis of the cylinder or working chamber of FIGS. 9, 10,12 and 13 are replaced by rotary valves with axes normal to the axis of the respective working chamber or cylinders.

Such arrangement must, however, obey the condition of this invention, that the device is able to expel a very high percentage of the compressed fluid out of the working chamber. Or, in other words, the dead space in the working chamber shall be zero or a smallest possible minimum.

These features are obtained in the embodiment of FIG. 14 thereby, that the rotary valve(s) 310 and/or 311 engage the working chamber 391 directly. The head of the working chamber 391 forms at least one seat for the reception of at least one rotary valve thereon. In order to prevent dead space, the piston head receives a configuration portion of at least one radius 305 and/or 306 to make the outer face(s) of the piston 301 complementary to the outer diameter of the respective valve(s) 310 and/or 311. When there are two valves 310 and 311, a medial face 307 remains between said valves as chamber head face 307 and the piston 301 becomes then a complementary medial piston head face 304. Thus, when the piston 301 is in its inner dead point location the face(s) 303 and/or 302 and/or 304 of the piston head are engaging or are coming to almost engagement with the outer face(s) 340 and/or 341 and/or 307 of the valve(s) 310 and/or 311 and/or the chamber head medial face 307. Space between said faces is then zero or negligibly small, so, that all or almost all compressed air or gas of the working chamber 391 can become delivered into the respective rotary valve(s) 310 or 311.

In this connection it should be recognized that the rotary valve(s) of the Figures have the advantage that they are able to carry almost all fluid out of the working chamber in a better extent that an axially moveable valves of FIGS. 1 to 3 do. Because the valves of FIGS. 1 to 3 can let fluid out of the working chamber 391 or 91 only as long as they are still slightly open. On contrary thereto, the opening or closing of the rotary valves of the Figures of this invention do not have any movement toward the working chamber(s) 91 or 391. The rotary valves of the Figures of the invention keep their axes where they are and so the outer faces. Consequently the piston(s) 72,372 are able to move so close toward the outer face of the rotary valve(s) that there remains almost no or only a negligibly small distance between the outer face(es) 340,341, and the respective piston head face portion(s) 303,302 etc. Once the fluid is fully delivered into the respective recess or port 312,313, or 386,387,388,389 of FIG. 15) of the respective rotary valve 310,311,380,381, the port just rotates away with the delivered fluid in it. After the port is closed by running over a respective seat portion of the valve seat in head portion 327 no fluid can escape any more from the valve for return into the working chamber 391 or 399. The fluid is delivered and remains delivered from the respective working chamber 391,399 into the respective valve 310,311,380,381 or like.

Figure 15:
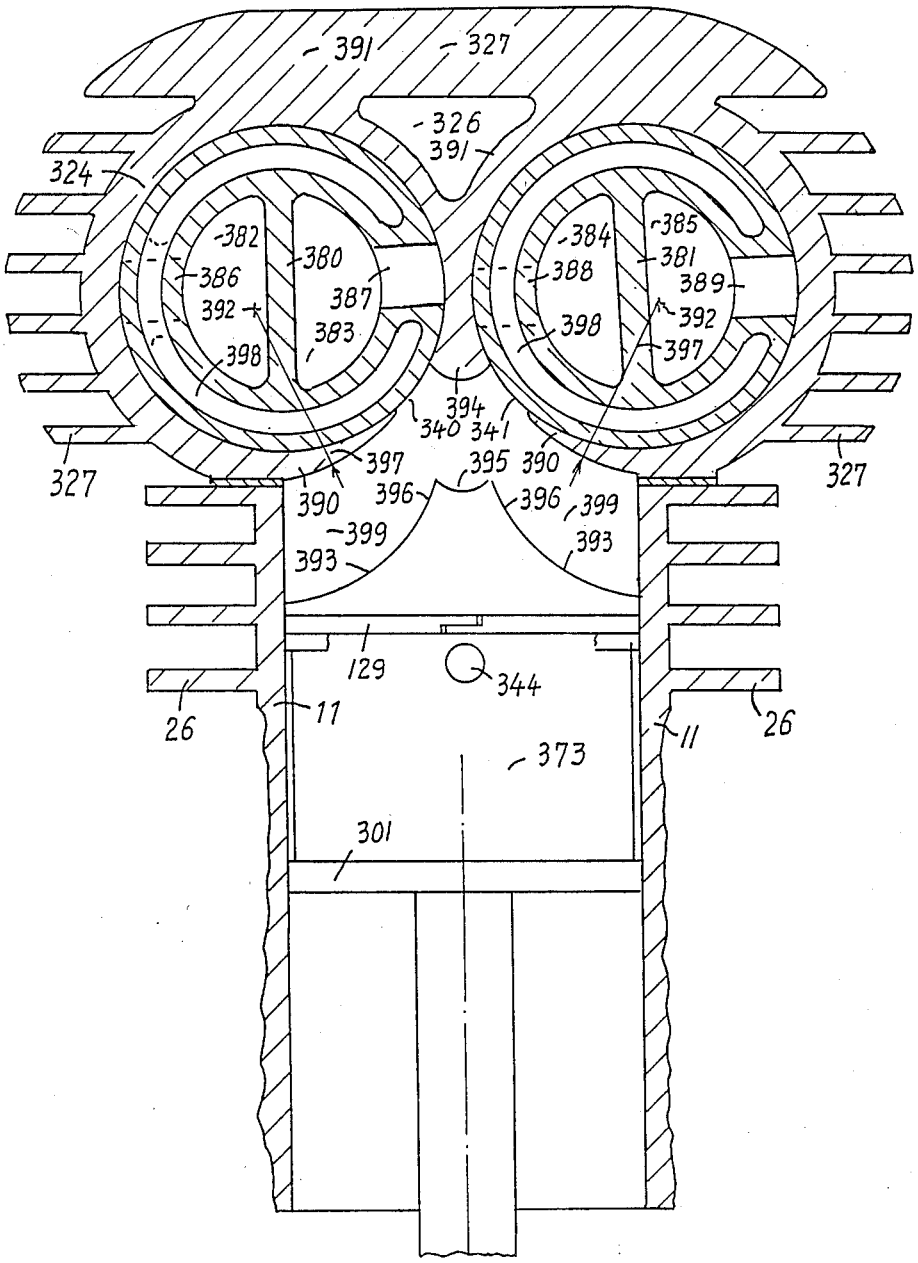
FIG. 15 is a longitudinal sectional view through still another embodiment of the invention.

The rotary valves are timed to open the respective entrance- or exit port to the respective working chamber 391 or 399 of FIGS. 14 or 15. The rotary valves of these Figures may be driven in unison but in certain transmission ratios by the drive means of the pistons, for example by the crankshaft. Respective transmission means between the drive means, for example crankshaft, and the rotary valves are assembled, but not shown in the Figures, because they are of secondary importance compared to the fluid delivery and exit action of the rotary valves of these Figures.

The valves 310 and/or 311 may have plural passages i.e., 314 to 317 and/or 318,319 or 320,321 for fluid delivery, fluid exit or for cooling fluid flow which may include cooling return flow. Respective ribs 322 or 323 may be incorporated in the valves 310 or 311 for separating passages from each other or for the provision of nondeformable ridigity of configuration of the outer face(s) 340,341 of the valve(s). Respective ribs and passages may also be set in the valves of FIG. 15 for similar purposes if so desired.

Axially offset may radial fluid pressure balancing pockets 324 and/or 325 be provided radially opposite of the engaged chamber 391 portions in the head body 327 for radially balancing the forces of fluid exerted onto the respective valve(s) 310,311 or those of FIG. 15. Such radial balancing of the rotary valves in order to make them float in their seats and along forces out of the respective working chamber 391,399 and like with little friction or with only fluid friction and to make them rotate without excessive load and friction on seat faces is more in detail shown in my U.S. Pat. No. 4,546,743. Rotation of the pistons around their axes may be prevented by retainer pins 344 in seats 301.

The arrangements of FIGS. 14 and 15 look widely similar at first glimpse. FIG. 15 may have, as FIG. 14, one or more rotary valve(s) 380 and/or 381 with outer face(s) 340 and/or 341.

Valves 380 and 381 show cooling spaces 398 surrounding the inner passages 382,383,384 or 385 in the respective valve and thereby the cooling passages 398 engage the outer portions of the valves effectively in order to cool the outer faces 340 and/or 341 and thereby to assist the maintenance of exact cylindrical outer face configuration without major deformations whereby the ability to slide and to seal of the outer faces 340,341 of the valves 380,381 is ensured.

Valves 380 and 381 may have smaller ports 387,389 or 386,388 than the valves 310 and 311 of FIG. 14. The wider valve ports are for higher speed engines with high or medial pressure, while the valves 380,318 of FIG. 15 with the narrower ports 386 to 398 may be applied on slower running, but highest pressure engines. The narrower ports shorten the extension of the delivery stroke of the compressor.

FIG. 15 also shows lips 390 extending partially into the working chamber and embracing portions of the valves 380,381. The inner portion 394 between valves 380 and 381 is also more extended than that with referential 307 of FIG. 14. In order to eliminate dead space and thereby to prevent incomplete delivery of gas out of the compressor, the lips 390 may have outer faces of radii 397 around points 392 with points 392 unequal to the axes of the valves 380,381 and the piston 373 must then have a piston head with five face portions; namely outer head portions 393 with radii 397, complementary to the respective faces of the lips 390, a medial piston head portion face 395 complementary to the medial portion 394 configuration and two medial piston head face portions 396 with radii corresponding to the radii of the outer diameter(s) of the valve(s) 380 and 381, but complementary configurated relatively to the outer face(s) 340, 341 of the valve(s) 380 and/or 381.

Such five configuration portions of the top face of the respective piston may also occur, when the diameter of the valve is considerably smaller than that of the size relation of FIGS. 14 or 15.

When the diameter of the valve(s) is relatively small compared to the diameter of the cylinder, there will necessarily be a portion or portions of the head body 327 used together with the valve(s) to close the respective cylinder. Thereby the closing faces in top of the cylinder form necessarily three of five or more face-portions of different configuration and the respective pistons then require also three or five or more complementary face portions in order to fulfill the condition of the application, that the dead space in the cylinder shall be almost zero at inner dead point of the piston in order to ensure full delivery of the gas out of the respective cylinder.

A preferred convenience is to let the valve(s) 310,3110 or 380,381 not only revolve or pivot, but also to move them axially. For example oscillate them along their axes by a respective drive means. Such axial movement of the said valve(s) makes a lapping action between the outer face of the valve and the bearing bed or seat wherein the respective valve is borne. That smoothens the surfaces, maintains the accuracy of configuration of the along relative to each other moving faces and provides an effective distribution of a lubrication fluid for a narrow fluid film or part-lubrication between the outer faces of the valve(s) and the inner face(s) of the seats, wherein the valves are borne. Such lubrication may take place out of the fluid pressure balancing recesses 324 or 325 on the diametric portions of the valve(s), body 327, or other suitable means.

Figure 16:
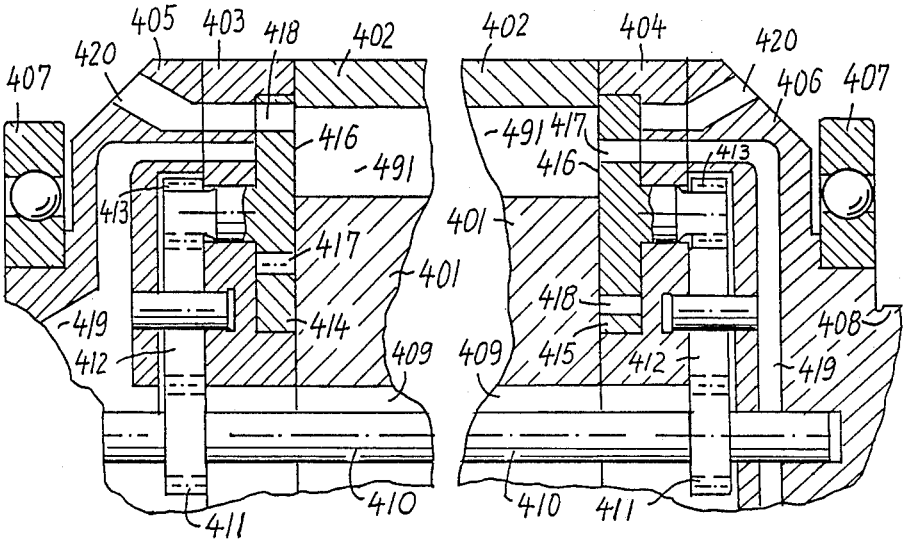
FIG. 16 is a longitudinal sectional view through still a further embodiment of the invention.

In FIG. 16 the rotary valves of the invention are mounted into a radial chamber device, like a compressor, expander or an engine. The radial chamber device is such device, which takes in and expels fluid in chambers, which vary their volumes periodically radially. Such devices are, for example, radial vane machineries, radial piston machines, gear pumps, motors, internal gear devices or trochoid gear devices. The Figure shows a vane machine having a rotor 401 borne in bearings 407 and revolving therein. The rotor 401 has endwalls 403 and 404 as well as if desired further outer end walls 405 and 406 which may be stationary but which are revolving in unison in the Figure together with rotor 401. An enclosing member 402 is mounted radially of the rotor 401 and forms between the rotor 401, enclosing member 402 and end walls 403 and 404 a working space which is divided by vanes which are borne in slots in the rotor and which extend radially beyond the rotor 401 for engagement and seal on the inner face of member 402 into a plurality of individual working chambers 491 which periodically at rotation increase and decrease their volumes. That is mostly accomplished by distancing the inner face of member 402 at different angular locations differently long from the outer face of rotor 401.

According to this embodiment of the invention an inlet passage 409 for example in the rotor hub is provided and may branch out into inlet passage arms 419 to port onto the end face of the respective valve or valves 414 and/or 415. Said valve(s) are rotatably borne in the endwalls and/or rotor 403,404,405,406 or 401. The valve(s) have an inner face 416 engaging partially the end of the individual working chamber 491 and they may be partially guided on portions of the end faces of the rotor 401. The valve(s) 414,415 have inlet ports and outlet ports 417 and 418. The endwalls 403 to 406 or a part thereof may have the outlet passages 420. If so desired the inlet passages may be reversed to be outlet passages and vice versa. A drive means, for example shaft 410 is provided to drive the rotary motion of the valve 414 and or 415. The drive means may include gear members 411,412 and/or 413.

The right side of the Figure shows an inlet port 417 of valve 415 in engangement with the individual working chamber 491. The left side of the Figure shows an outlet valve port 418 in engagement with the working chamber 491 which may now have revolved relatively to the right side of the Figure. The Figure also shows, that those parts, which are not engaging at the respective time the working chamber 491 are closed by the respective seat faces or portions between the rotor 401 and endwalls 403,404.

Figure 17:
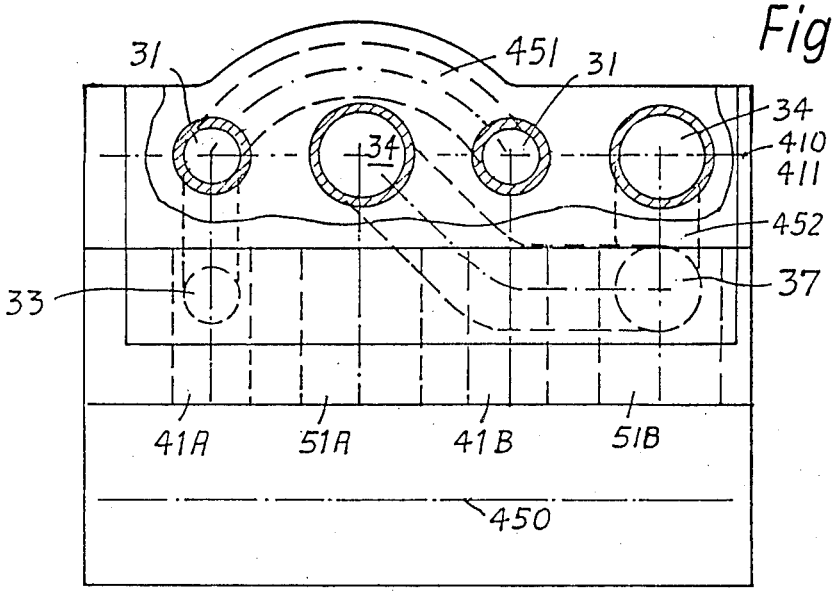
FIG. 17 shows in a schematic a view upon a multiple cylinder engine of the invention.

FIG. 17 is a schematic Figure and explains, that a plurality of cylinders 41A,51A,41B and 51B may be combined to co-operate with a single combustion chamber unit of FIG. 2. Outlets 31 of the respective cylinder port into a common collection passage 451 to enter thereafter into the inlet 33 of the combustion chamber 64. Outlet 37 of the combustion chamber 64 twins out into two delivery passages 452 to deliver the gas into the entrance ports 34 of cylinders 51A and 51B. Referential 450 shows the common crankcase of the piston-drive in the cylinders 41A,B and 51A,B. Referentials 410,411 show the housing of the rotary valves or the cylinder head containing the said valves. The valves may, however, also be valves of other Figures of the application.

Attention is drawn to the common collection passage 451 and to the common or twined or multiplied delivery passage 452. The common collection passage may be utilized if so desired, to exert it to a cooling device to cool the compressed gas. When that is done, the device can operate with higher pressures and thereby with higher thermodynamic efficiency without reaching too high, or not managable, end temperatures. The common or branced distribution passage 452 may have sacks toward a lower location for collecting non-burned particles therein for removal at a desired time.

The common collection passage 451 and the common distribution passage 452 may, therefore, obtain different configurations and locations than shown in the drawing, in order to fulfill the cooling action or the dust collecting action in respective portions of them.

FIG. 17 also shows, that the compression delivering cylinders 41 A,B are of a smaller diameter than the expansion taking cylinders 51 A,B. The pressure in the combustion chamber inlet and outlet may be equal. That means combustion at constant pressure. The expansion cylinders 51 A,B, then first of all drive the compression cylinders 41 A,B and the rest of power obtained in the cylinders 51 A,B with the bigger diameter is then the delivered power of the engine. Of course, the losses and the powers for the accessory drives are also to be subtracted from the expansion power. When said losses would be neglected, the difference of cross-sectional area of cylinders 51 minus that of cylinders 41 multiplied with piston strokes and average pressures in the cylinders would give the power of the engine.

From the beforegoing it will also be apparent, that a number of novel solutions have been shown.

In a device which operates fluid, the economy of the operation and the reliability thereof is important too.

To make such a device operable in the above spirit, it should be noted, that a device can not work better than its most bad part.

Therefore, it is important with this invention, to set the accurate parts in accurate configurations with appropriate actions at the right locations. The success of the device thus depends not only on the main principles but in great detail on the details and parts of the device.

The configurations, locations, directions of actions, movements and speed of the parts or portions of the device are therefore important means to obtain the desired overall success of the device and they should not be neglected. Failure of a single design or principle of a single one of the parts or portions can bring the device to failure. The details of this disclosure are therefore at least partially as important as the the major principles are.

For converting coal into gasoline, the transformation is very efficient with 80 to 98 percent, however, the converting process requires two to three times more energy—usually coal—than volume or weight of coal is converted into gasoline. Thus, only roughly a third of the sum of the coal used for conversion and for operation of the conversion process becomes gasoline, but the other main portion is basically lost.

What is claimed, is:

1. A device for the handling of flows of fluid through ports and chambers, comprising, in combination, a housing with a therein revolvably borne rotor which has a plurality of cylinders with therein reciprocable pistons, while said rotor is provided with a longitudinal medial axis and with a radially planar head face which is normally directed relative to said axis, with said cylinders provided individually around angularly spaced axes which are radially distanced from said axis by a first radial distance and which port into and through said head face, while said housing includes a housing portion which houses a plurality of valves which are individually moveable around their respective longitudinal medial valve axes, with said valves having radially planar tip faces which are directed towards said head face of said rotor, with said valve axes parallel to said axis of said rotor but angularly spaced and radially distanced from said axis of said rotor by a second radial distance, with said housing portion provided with ports and said valves provided with passages which extend from said tip face of the respective valve through the respective valve to a rear face of the respective valve, while said second radial distance is greater than said first radial distance, said valves and said rotor are provided with a transmission to move said valves around said valve axes in a fixed relation relative to the rotary velocity of said rotor, said passages alternatingly communicating and discommunicating a respective port of said ports of said housing portion with a respective cylinder of said cylinders of said rotor when said valves are moved around their valve axes;

an an improvement which includes the provision of gearing means provided in said transmission which alternatingly at equal rotary angles of said rotor communicate said cylinders by said valves at the first revolution of a two revolution cycle with first ports in said housing and at the second revolution of said cycle with second ports of said housing.

2. The device of claim 1, wherein said first ports are communicated to hot gases of a combustion chamber of a combustion engine, while said second ports are located to the cool air of the outside atmosphere, whereby the respective cylinder of said cylinders is at one revolution of said cycle communicated and filled with said hot gas while at the other revolution of said cycle is communcated and filled with said cool air of the atmosphere.

3. The device of claim 1, wherein said transmission includes gears which are provided with a transmission ratio between said rotor and each of said valves for reversing the angular rotary direction of said valves respective to the angular rotary revolution of said rotor and for revolving said valves with a rotary angular velocity which is 0.5 times of the number of cylinders of said rotor faster than the angular rotary velocity of said rotor.

4. The device of claim 1, wherein flush flow ports are provided in said housing for the periodic communication with passages through said valves for periodically at two revolution cycles sending a cooling flush flow through the respective cylinders of said rotor.

5. The device of claim 1, wherein each of said cylinders moves at one revolution through an intake action and an expulsion action with said action effected by the reciprocating strokes of said pistons, wherein said device is subjected to four-revolution cycles of said rotor and wherein said transmission subjects said cylinders to different successions of communications to ports at the last two revolutions of said cycle relative to the first two revolutions of said cycle.

6. A device for the handling of flows of fluid through ports and chambers, comprising, in combination, a housing with a therein revolvably borne rotor which has a plurality of cylinders with therein reciprocable pistons, while said rotor is provided with a longitudinal medial axis and with a radially planar head face which is normally directed relative to said axis, with said cylinders provided individually around angularly spaced axes which are radially distanced from said axis by a first radial distance and which port into and through said head face, while said housing includes a housing portion which houses a plurality of valves which are individually moveable around their respective longitudinal medial valve axes, with said valves having radially planar tip faces which are directed towards said head face of said rotor, with said valve axes parallel to said axis of said rotor but angularly spaced and radially distanced from said axis of said rotor by a second radial distance, with said housing portion provided with ports and said valves provided with passages which extend from said tip face of the respective valve through the respective valve to a rear face of the respective valve, while said second radial distance is greater than said first radial distance, said valves and said rotor are provided with a transmission to move said valves around said valve axes in a fixed relation relative to the rotary velocity of said rotor, said passages alternatingly communicating and discommunicating a respective port of said ports of said housing portion with a respective cylinder of said cylinders of said rotor when said valves are moved around their valve axes;

and an improvement which includes gearing means provided in said transmission on said rotor and on said valves with teeth of gears on said valves meshing with a gear on said rotor to reverse the rotary direction of said valves relative to the rotary direction of said rotor.

7. The device of claim 6, wherein said device is communicated by at least two of said ports of said housing portion to ingoing and outgoing passages of a combustion engine, respectively, while at least two others of said ports of said housing portion are communicated at least indirectly to the outside atmosphere, whereby at least two of said ports of said housing are communicated to hot gas passages while at least two of said ports of said housing portion are communicated to cool air of the surrounding atmosphere, and, wherein in response to a transmission ratio each of said cylinders of said rotor communicates at the first revolution of a two-revolution cycle with said hot gas and at the second revolution of said cycle with said cool air of the atmosphere, or vice versa.

8. The device of claim 6, wherein said transmission is provided between said gear of said rotor and said gears of said valves, while said transmission defines by the number of teeth of said gear of said rotor relative to the number of teeth of a respective gear of a respective valve a transmission ratio of said gear of said rotor to said gear of said respective valve equal to one half of the number of cylinders which are provided in said rotor.

9. The device of claim 8, wherein an uneven number of cylinders is provided in said rotor and said rotor operates in cycles which consist of two successive revolutions of said rotor and said ratio provides that each cyliner of said rotor meets at the first revolution of said cycle a first communication of said control ports to one of said ports of said housing portion with the respective cylinder of said rotor meeting at the second revolution of said cycle a second communication of the respective control port with a second port of said ports of said housing portion.

10. A device for the handling of flows of fluid through ports and chambers, comprising, in combination, a housing with a therein revolvably borne rotor which has a plurality of cylinders with therein reciprocable pistons, while said rotor is provided with a longitudinal medial axis and with a radially planar head face which is normally directed relative to said axis, with said cylinders provided individually around angularly spaced axes which are radially distanced from said axis by a first radial distance and which port into and through said head face, while said housing includes a housing portion which houses a plurality of valves which are individually moveable around their respective longitudinal medial valve axes, with said valves having radially planar tip faces which are directed towards said head face of said rotor, with said valve axes parallel to said axis of said rotor but angularly spaced and radially distanced from said axis of said rotor by a second radial distance, with said housing portion provided with ports and said valves provided with passages which extend from said tip face of the respective valve through the respective valve to a rear face of the respective valve, while said second radial distance is greater than said first radial distance, said valves and said rotor are provided with gearing means which form a transmission to move said valves around said valve axes in a fixed relation relative to the rotary velocity of said rotor, said passages alternatingly communicating and discommunicating a respective port of said ports of said housing portion with a respective cylinder of said cylinders of said rotor when said valves are moved around their valve axes;

and an improvement which includes the provision of second passages in said valves and second ports in said housing portion with said second passages moveable over said second ports and extending from said tip faces through portions of said valves to end in radial valve ports on the radial peripheries of said valves, while said passages and said second passages form in said tip faces control ports around control port centers with said centers of said control ports radially distanced from said axes of said valves by equal radial control port distances.

11. The device of claim 10, wherein said control ports of a respective valve are subjected by said transmission for alternating communication of one of said cylinders to one of said ports and said second ports in said housing portion.

12. The device of claim 10, wherein said tip faces and said control ports of said valves are at least partially located to directly engage, meet and seal along portions of said head face of said rotor.

13. The device of claim 10, wherein said transmission is provided between a gear of said rotor and gears of said valves, while said transmission defines by the number of teeth of said gear of said rotor relative to the number of teeth of a respective gear of a respective valve a transmission ratio of said gear of said rotor to said gear of said respective valve equal to one half of the number of cylinders which are provided in said rotor.

14. The device of claim 13, wherein an uneven number of cylinders are provided in said rotor and said rotor operates in cycles which consist of two successive revolutions of said rotor and said ratio provides that each cylinder of said rotor meets at the first revolution of said cycle a first communication of said control ports to one of said ports of said housing portion with the respective cylinder of said rotor meeting at the second revolution of said cycle a second communication of the respective control port with a second port of said ports of said housing portion.

* * * * *